US007597416B2

(12) United States Patent
Takata

(10) Patent No.: US 7,597,416 B2
(45) Date of Patent: Oct. 6, 2009

(54) INK-JET RECORDING APPARATUS

(75) Inventor: Masayuki Takata, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 541 days.

(21) Appl. No.: 11/591,265

(22) Filed: Nov. 1, 2006

(65) Prior Publication Data

US 2007/0120888 A1 May 31, 2007

(30) Foreign Application Priority Data

Nov. 1, 2005 (JP) ..... 2005-318091

(51) Int. Cl.
*B41J 29/38* (2006.01)

(52) U.S. Cl. ..... 347/17; 347/18; 347/85

(58) Field of Classification Search ..... 347/17, 347/18, 20, 43, 44, 47, 56, 61–65, 67, 84–87
See application file for complete search history.

(56) References Cited

U.S. PATENT DOCUMENTS 5,359,357 A 10/1994 Takagi et al.
6,270,205 B1 * 8/2001 Takata ..... 347/85
2005/0088494 A1 4/2005 Shimizu et al.
2005/0151796 A1 7/2005 Kubo

FOREIGN PATENT DOCUMENTS

EP 1 537 999 6/2005
JP 2005-125635 7/2005
JP 2005-193579 7/2005

* cited by examiner

*Primary Examiner*—Juanita D Stephens
(74) *Attorney, Agent, or Firm*—Reed Smith LLP

(57) ABSTRACT

An ink-jet recording apparatus includes an ink tank in a layered form and having a plurality of ink storage chambers storing color inks; a driving circuit; a heat transfer plate; and a recording head having a plurality of nozzle rows arranged in one direction. The heat transfer plate is in contact with the driving circuit and faces, at a spacing distance, an ink storage chamber, among the ink storage chambers, storing a yellow ink included in the color inks, and formed on the lowest layer of the ink tank. The yellow ink is supplied to a center nozzle row among the nozzle rows. This construction reduces an influence on printing quality due to variation in extent by which the color inks are influenced by the heat from the driving circuit, thereby providing an ink-jet recording apparatus which can realize high-quality printing and made to be compact.

16 Claims, 14 Drawing Sheets

INK-JET RECORDING APPARATUS

CROSS REFERENCE TO RELATED APPLICATION

The present application claims priority from Japanese Patent Application No. 2005-318091, filed on Nov. 1, 2005, the disclosure of which is incorporated herein by reference in its entirety.

BACKGROUND OF THE INVENTION

1. Field of the Invention

The present invention relates to an ink-jet recording apparatus which jets inks of a plurality of colors.

2. Description of the Related Art

There has conventionally been known an ink-jet recording apparatus which performs recording to a recording medium by jetting inks of a plurality of colors from a recording head. An ink-jet recording apparatus described in U.S. Patent Application Publication No. US 2005/151796 A1 (corresponding to Japanese Patent Application Laid-open No. 2005-193579) includes two recording heads, and on each of the recording heads, a plurality of nozzle rows corresponding to inks of a plurality of colors (a plurality of color inks), respectively, are arranged in parallel, and in each of the nozzle rows, a plurality of nozzles are arranged in a line. These two recording heads are supported on a bottom of a head holder to face a recording medium. In each of the recording heads, a cavity plate formed of a stack of a plurality of plates, a piezoelectric actuator, and a flexible wiring member extending in a direction in which the nozzle rows are arranged are stacked. On the flexible wiring members, IC chips, as driving circuits for driving the piezoelectric actuators, are provided and are partly in contact with a heat sink in a heat conductive manner.

In recent years, in response to a demand for a higher speed and a miniaturization of an ink-jet recording apparatus, processing speed of a driving circuit, the number of nozzles of recording heads, and integration density have been made on an increasing tendency. With this tendency, an amount of heat generated by the driving circuit has become larger. Accordingly, the temperature of a heat sink itself for releasing the heat of the driving circuit has become higher, which then has led to an increase in temperature of the whole space in a head holder holding the heat sink. The heat of the driving circuit is also transferred or transmitted to ink tanks in the head holder and to the recording head, via the space in the head holder, thereby heating inks flowing through the inside of the head holder also. As viscosity of the ink becomes lower due to the increase in the temperature of the ink, the jetting velocity or speed of the ink becomes higher, which in turn causes deviation from an intended landing position, variation in dot diameter, and/or the like, resulting in unstable jetting accuracy. Furthermore, due to variation in heat influence among the inks, there occurred variation in temperature among the inks, which has been a cause of deterioration in printing quality.

Generally, an ink-jet recording apparatus uses not only inks of basic colors of yellow, magenta, cyan, and black but also inks of intermediate colors such as light yellow and light magenta and inks of red, green, and blue, thereby eliminating granular texture and realizing printing quality rich in color tones. If deviation from an intended landing position or variation in dot diameter occurs in these inks, a printing error of a deeper ink color is more emphasized or more conspicuous (visible) and a printing error of a lighter ink color is less conspicuous. Conversely speaking, a printing error such as deviation from the landing position or variation in dot diameter of some color is more conspicuous to human eyes and a printing error of some other colors is less conspicuous to human eyes. Here, the term "light-color ink" refers to an ink of low-visibility color such as, for example, a yellow ink, and the term "deep-color ink" refers to an ink of high-visibility color such as, for example, a black ink.

SUMMARY OF THE INVENTION

Ink tanks storing these inks are affected by the aforesaid influence of the heat (thermal influence) from the driving circuit, and an ink stored in an ink tank closer to the driving circuit is more greatly affected by the thermal influence. That is, an ink in an ink tank disposed or arranged close to the driving circuit becomes higher in temperature than an ink stored in an ink tank disposed farther or distant from the driving circuit, and as a result, the former ink is jetted unstably, resulting in the deterioration of printing quality. Especially in a case where a black ink tank is disposed closest to the driving circuit, unstable jetting of the black ink is easily occurred, and in this case, a printing error thereof is remarkably conspicuous. Furthermore, in a mode of printing using only color ink or inks or in a case of printing a photograph or the like with little use of a black ink, the heat held in the black ink in the black ink tank is not released because the black ink is hardly jetted. Therefore, the black ink is kept stored in the ink tank in a state that its temperature is not decreased, which consequently has posed a problem that the jetting of the black ink, when it is used the next time, becomes remarkably unstable.

In U.S. Patent Application Publication No. US 2005/151796 A1, in each of the recording heads, the nozzle rows are arranged in such a manner that a nozzle row corresponding to a yellow ink is the closest to the driving circuit and a nozzle row corresponding to a black ink is the farthest from the driving circuit. The ink tanks supplying the inks to the nozzle rows are also arranged in such manner that a yellow ink tank is disposed at a position closest to the driving circuit and a black ink tank is disposed at a position farthest from the driving circuit, whereby making the black ink to be less affected by the thermal influence from the driving circuit.

In view of the above-mentioned problem, it is conceivable to dispose a driving circuit and a heat sink (heat transfer plate) away from a plurality of ink tanks and nozzle rows, thereby reducing the thermal influence to the inks, but disposing the heat transfer plate and the ink tanks away from each other requires an increase in the size of the recording head and causes an increase in manufacturing cost, and thus is not preferable.

The present invention was made to solve these problems, and it is an object of the present invention to provide an ink-jet recording apparatus which can be made compact and which can realize high-quality printing by reducing an influence to printing quality caused by variation in the influence of heat from a driving circuit to inks in a plurality of colors.

According to a first aspect of the present invention, there is provided an ink-jet recording apparatus which performs recording by jetting a plurality of color inks including a deep-color ink and a light-color ink, the apparatus including:

a recording head which has a plurality of nozzle rows arranged in a predetermined arrangement direction corresponding to the color inks, respectively, each of the nozzle arrays having a plurality of nozzles, and which applies pressures to the color inks to jet the inks from the nozzles;

a plurality of ink storage chambers storing the color inks respectively;

a plurality of ink supply ports through which the inks are supplied from the ink storage chambers to the nozzle rows, respectively;

a driving circuit which drives the recording head; and a heat transfer plate which is in contact with the driving circuit in a heat-conductive manner and which is disposed adjacent to the ink storage chambers; wherein:

an ink storage chamber, among the ink storage chambers, which stores the deep-color ink is disposed at a position, with respect to the driving circuit and the heat transfer plate, at which heat generated by the driving circuit and the heat transfer plate is transferred to the ink storage chamber to an extent smaller than to another ink storage chamber which stores the light-color ink; and a color ink, among the color inks, which is stored in an ink storage chamber among the ink storage chambers and heated most by the heat, is supplied to a nozzle row which is different from nozzle rows disposed outermostly in the nozzle rows.

According to the first aspect of the present invention, the heat transfer plate is in contact with the driving circuit in a heat conductive manner and is disposed adjacent to the ink storage chambers, and the ink storage chambers are arranged in a positional relationship with respect to the driving circuit and the heat transfer plate such that at least the ink storage chamber storing the deep-color ink is heated, by the heat generated by the driving circuit and the heat transfer plate, an extent smaller than the ink storage chamber storing the light-color ink. Therefore, the deep-color ink can be made to less likely, than the light-color ink, to be affected by the thermal influence from the driving circuit and the heat transfer plate. Consequently, it is possible to reduce the deviation from a landing position and variation in dot diameter size of the ink of the high-visibility deep color, thereby making a printing error to be less conspicuous.

Further, among the ink storage chambers, the color ink in the ink storage chamber heated most by the heat is supplied to a nozzle row which is different from the nozzle rows disposed outermostly in the nozzle rows. Accordingly, the ink which is most affected by the thermal influence from the driving circuit and the heat transfer plate and which is thus holding the heat in the largest amount is supplied to a nozzle row which is disposed at a position closer to the center, and which is different from the nozzle rows disposed outermostly in the nozzle rows of the recording head. Therefore, as the ink flows into the nozzle rows from the ink supply ports, respectively, the heat held by the ink in the nozzle row disposed at the position closer to the nozzle-row center is transferred from the inner side to the outer side of the nozzle rows. Therefore, the thermal influence to the nozzle rows can be made uniform and variation in the amount of heat held by the inks of respective colors can be reduced, thereby realizing high-quality printing.

In the ink-jet recording apparatus of the present invention, the ink storage chambers may be arranged in a predetermined direction; the heat transfer plate may be disposed to face an ink storage chamber, among the ink storage chambers, which is disposed at one end in the predetermined direction; the ink storage chamber storing the deep-color ink may be disposed at a position farther from the heat transfer plate than the ink storage chamber storing the light-color ink; and a color ink among the color inks and supplied from an ink storage chamber, among the ink storage chambers, which faces the heat transfer plate and which is disposed most closely to the heat transfer plate, may be supplied to the nozzle row which is different from the nozzle rows disposed outermostly.

In the ink-jet recording apparatus of the present invention, the heat transfer plate is disposed to face the ink storage chamber disposed at one end in the direction in which the ink storage chambers are arranged (arrangement direction); and among the ink storage chambers, at least the ink storage chamber storing the deep-color ink is disposed at a position farther from the heat transfer plate than the ink storage chamber storing the light-color ink. Therefore, the deep-color ink can be made less likely to be affected, than the light-color ink, by the thermal influence from the heat transfer plate. Therefore, it is possible to reduce the deviation from the landing position and the variation in dot diameter size of the deep-color ink having high-visibility, thereby making a printing error thereof to be less conspicuous. Further, the color of the ink, stored in the ink storage chamber which faces the heat transfer plate and thus is given the largest thermal influence (is most affected by the thermal influence), is the light color which is low in visibility. Accordingly, a printing error of the light-color ink is less conspicuous even if the deviation from the landing position and/or the variation in dot diameter size occurs due to the thermal influence, and thus there is no fear that the deterioration in printing quality is occurred.

The heat transfer plate is disposed to face the ink storage chamber disposed at one end in the direction in which the ink storage chambers are arranged. Since this structure makes it possible to dispose the heat transfer plate in a vacant space in a conventional structure, it is possible to increase a surface area of the heat transfer plate to secure a large heat release amount while realizing the compactness. Although it is generally desired that heat conduction to the inks from the driving circuit is smaller, in this structure, the heat is transferred, from the driving circuit held by the heat transfer plate, in a large amount especially to the ink storage chamber storing the light-color ink among the ink storage chambers. However, since this ink is especially the light-color ink, any printing error thereof due to the deviation from landing position and/or the variation in dot diameter size, if any, is less conspicuous, and further, the heat release effect of the heat transfer plate can be made higher.

Furthermore, since the ink in the ink storage chamber facing the heat transfer plate and disposed closest to the heat transfer plate is supplied to nozzle row which is different from the nozzle rows disposed outermostly in the arranged nozzle rows. Therefore, as the ink, which is most affected by the thermal influence from the heat transfer plate and which thus holds the great amount of heat, flows into this nozzle row, the heat is transferred from the inner side to the outer side of the nozzle rows. Consequently, it is possible to reduce the variation in the amount of heat held by the inks of respective colors, thereby realizing high-quality printing.

In the ink jet recording apparatus of the present invention, the ink storage chamber, which faces the heat transfer plate and which is disposed most closely to the heat transfer plate, may store a color ink, among the color inks, which has a lightest color.

In this case, since the ink storage chamber facing and disposed most closely to the heat transfer plate stores the ink of the lightest color, that is, the ink of the lowest-visibility color, among the color inks, the ink of the lowest-visibility color is most likely to be affected by the thermal influence from the heat transfer plate. However, since this ink is low in visibility and any printing error thereof due to the thermal influence is less conspicuous, no deterioration in printing quality is caused. For example, the lightest ink color among black, yellow, cyan, and magenta is yellow. On the other hand, the deepest color among these colors is black.

In the ink-jet recording apparatus of the present invention, the ink storage chambers may function as damper chambers which absorb a pressure change in the color inks to be supplied to the recording head.

In this case, since the ink storage chambers function as the damper chambers absorbing the pressure change in the color inks to be supplied to the recording head, it is possible to prevent the deterioration in printing due to the pressure change in the inks, thereby improving the printing quality.

In the ink-jet recording apparatus of the present invention, one wall surface of each of the ink storage chambers may be formed of a flexible film.

In this case, since one wall surface of each of the ink storage chambers is formed of the flexible film, it is possible to easily make the wall surface to have a function as a damper.

In the ink-jet recording apparatus of the present invention, a color ink, among the color inks, stored in an ink storage chamber, among the ink storage chambers, facing the heat transfer plate and disposed farthest from the heat transfer plate, may be supplied to one of the nozzle rows disposed outermostly in the nozzle rows; and another color ink, among the color inks, supplied from an ink storage chamber, among the ink storage chambers, facing the heat transfer plate and disposed most closely to the heat transfer plate, may be supplied to the nozzle row which is different from the nozzle rows disposed outermostly.

In this case, the color ink in the ink storage chamber, facing the heat transfer plate and disposed farthest from the heat transfer plate, is supplied to one of the nozzle rows disposed outermostly; and the color ink in the ink storage chamber, facing the heat transfer plate and disposed closest to the heat transfer plate, is supplied to the nozzle row which is different from the nozzle rows disposed outermostly in the nozzle rows. Therefore, it is possible to supply the most heated ink to the nozzle row on the center side, which makes it possible to make the heat of the inks to be uniform among the nozzles.

In the ink-jet recording apparatus of the present invention, the ink storage chambers may be stacked in an up and down direction; a lower end of the heat transfer plate may be in contact with the driving circuit in the heat conductive manner, and the heat transfer plate may extend upward in parallel to a direction, in which the ink storage chambers are arranged, with a spacing distance from the ink storage chambers; the ink storage chamber storing the deep-color ink may be disposed at a position farther from an upper end of the heat transfer plate than the ink storage chamber storing the light-color ink; and an ink, in an ink storage chamber among the ink storage chambers and facing the upper end of the heat transfer plate, may be supplied to the nozzle row which is different from the nozzle rows disposed outermostly.

In this case, the ink storage chambers are stacked in the up and down direction, the lower end of the heat transfer plate is in contact with the driving circuit in the heat conductive manner, and the heat transfer plate extends in parallel along the direction, in which the ink storage chambers are arranged, with a spacing distance from the ink storage chambers; and the air in the head holder brought into convection by the heat of the driving circuit and the heat transfer plate stays or remains in the upper portion of the head holder. Therefore, the ink storage chamber facing the upper end of the heat transfer plate, that is, the ink storage chamber on the uppermost layer is most affected by the thermal influence. According to this structure, since the ink storage chamber storing the deep-color ink is disposed at a position farther or more distant from the upper end of the heat transfer plate than the ink storage chamber storing the light-color ink, it is possible to make the thermal influence from the driving circuit and the heat transfer plate to the deep-color ink smaller than that to the light-color ink. Therefore, it is possible to reduce the deviation from landing position and/or the variation in dot diameter size of the ink of the high-visibility deep color, so as to make any printing error thereof less conspicuous. Further, since the color ink stored in the ink storage chamber facing the heat transfer plate and thus mostly affected by the thermal influence is the ink of the low-visibility light color, any printing error thereof is less conspicuous even if the deviation from landing position and/or the variation in dot diameter size occurs due to the thermal influence, thereby causing no deterioration in printing quality.

Further, since the color ink in the ink storage chamber facing the upper end of the heat transfer plate is supplied to the nozzle row which is different from the nozzle rows disposed outermostly in the nozzle rows, it is possible to reduce the variation in the amount of heat held by the color inks, respectively, thereby realizing the high-quality printing.

In the ink-jet recording apparatus of the present invention, the ink storage chamber on an uppermost layer of the stacked ink storage chambers may store a color ink, among the color inks, which has a lightest color.

In this case, it is constructed such that the color ink having lightest color is stored in the ink storage chamber on the uppermost layer, and that the color ink having the lowest-visibility light color is most easily to be affected by the thermal influence from the driving circuit and the heat transfer plate. Therefore, even when any printing error occurs due to the thermal influence, the printing error is less conspicuous, thereby causing no deterioration in the printing quality.

In the ink-jet recording apparatus of the present invention, the deep-color ink may be a black ink. In this case, high-quality printing can be realized in a mode for printing a character and/or the like.

In the ink-jet recording apparatus of the present invention, the driving circuit may be positioned on one side of the ink storage chambers, may be in contact with the heat transfer plate in the heat conductive manner, and may be arranged in parallel to the nozzle rows. In this case, the heat generated from the driving circuit can be efficiently transferred to the heat transfer plate.

In the ink-jet recording apparatus of the present invention, the heat transfer plate may be formed of aluminum. In this case, heat conduction of the heat transfer plate can be satisfactorily improved.

In the ink-jet recording apparatus of the present invention, the heat transfer plate may have a sidewall and a horizontal wall, and may have a substantially L-shape form. Alternatively, the heat transfer plate may have a bottom surface and two body portions which project in a direction from both sides, respectively, of the bottom surface; and may have a substantially U-shape form. In either case, since the heat transfer plate has a large heat release portion, a heat release effect thereof can be enhanced.

The ink-jet recording apparatus may further include an ink tank having an upper ink case and a lower ink case; wherein the ink storage chambers may be formed in the upper ink case and the lower ink case respectively. In this case, for example, the upper ink case and the lower ink case can be bonded to be joined together after the ink storage chambers are formed in the upper ink case and the lower ink case, thereby making it possible to easily form the ink-jet recording apparatus.

In the ink-jet recoding apparatus of the present invention, each of the upper ink case and the lower ink case may have a wall partitioning an inside thereof into two layers; and each of the ink storage chambers may be formed in one of the layers. In this case, the walls are provided inside the ink cases to partition the inside of the cases, respectively, whereby making it possible to form the ink storage chambers stacked in layers.

In the ink-jet recording apparatus of the present invention, the ink tank may further include a discharge unit which discharges air separated from the inks. In this case, since the air separated from the inks can be discharged, there is no fear that the air separated from the inks reaches the recording head.

DETAILED DESCRIPTION OF THE PREFERRED EMBODIMENTS

Figure 1:
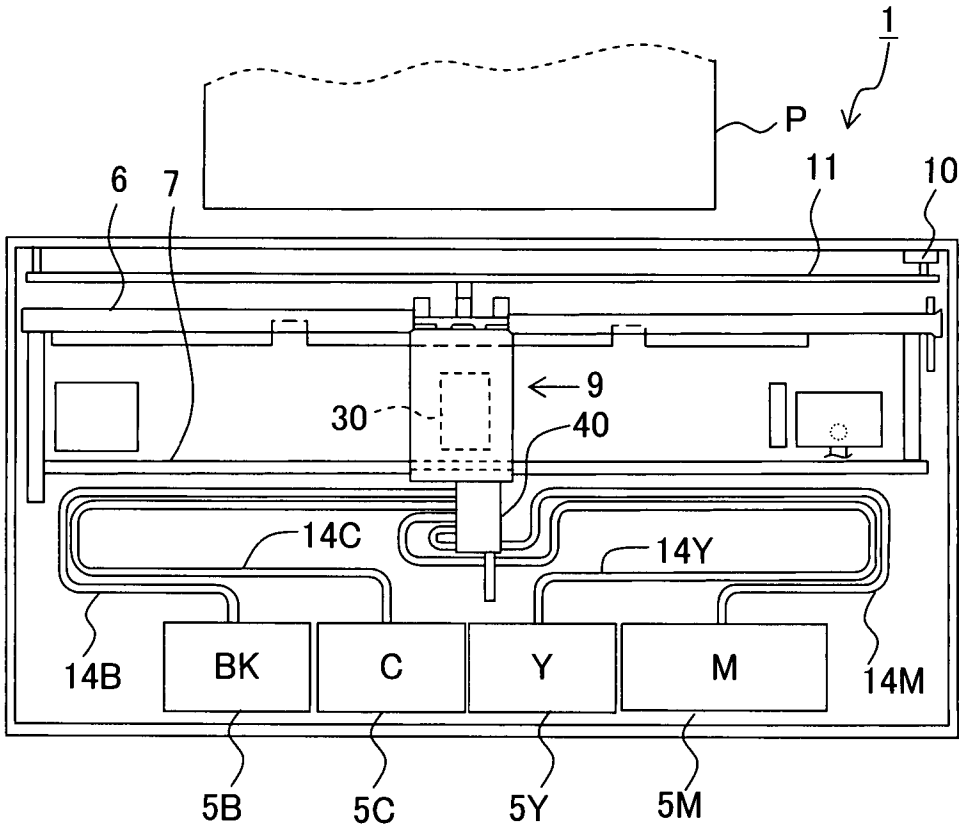
FIG. 1 is a plan view of a main portion of an ink-jet recording apparatus according to an embodiment of the present invention.

A first embodiment of the present invention will be explained. As shown in FIG. 1, in an ink-jet recording apparatus 1, a head holder 9 holding a recording head 30 which performs printing to a recording paper P by jetting an ink to the recording paper P and an ink tank 40 storing the ink are attached along guide shafts 6, 7. The head holder 9 also has a function as a carriage, is attached to an endless belt 11 which rotates when driven by a motor 10, and scan-moves along the guide shafts 6, 7.

The ink-jet recording apparatus 1 further has ink cartridges containing inks in a plurality of colors (a plurality of color inks), that is, an ink cartridge 5B for a black ink, an ink cartridge 5C for a cyan ink, an ink cartridge 5Y for a yellow ink, and an ink cartridge 5M for a magenta ink. The ink cartridges 5B, 5C, 5Y and 5M are connected to the ink tank 40 via flexible ink supply tubes 14B, 14C, 14Y, 14M respectively to supply the inks to the ink tank 40.

Next, the construction of the head holder 9 will be explained. In the following explanation, an ink-jetting side will be defined as a lower surface side and a lower direction and the opposite side will be defined as an upper surface side and an upper direction. Further, a left-end side and a right-end side of the drawing in FIG. 1 will be defined as a left direction and a right direction respectively, and a lower side and an upper side of the drawing in FIG. 1 will be defined as a front side and a back side respectively.

Suffixes M, C, B, Y indicate the association with magenta, cyan, black, and yellow respectively.

Figure 2:
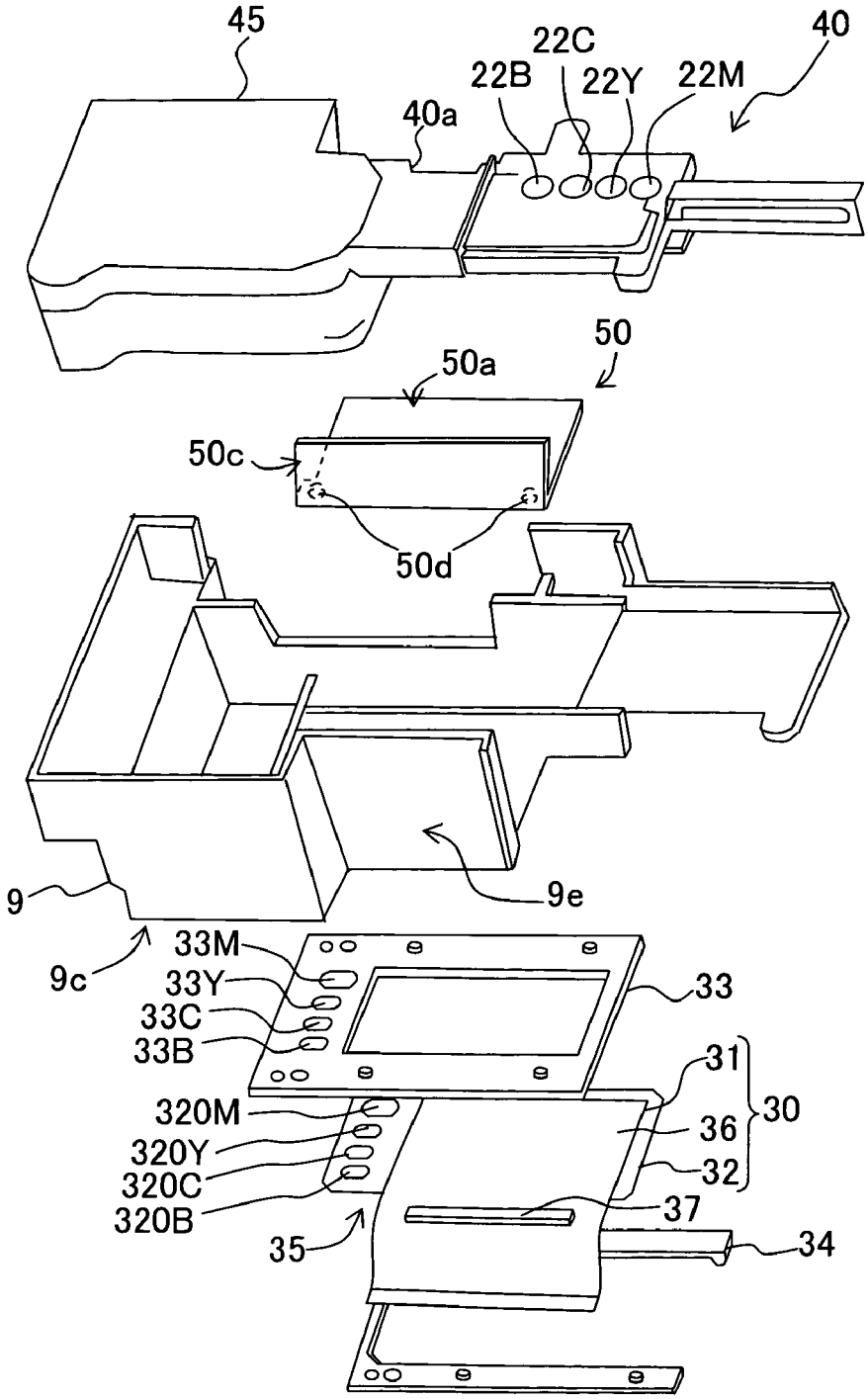
FIG. 2 is an exploded perspective view of a head holder.
Figure 4:
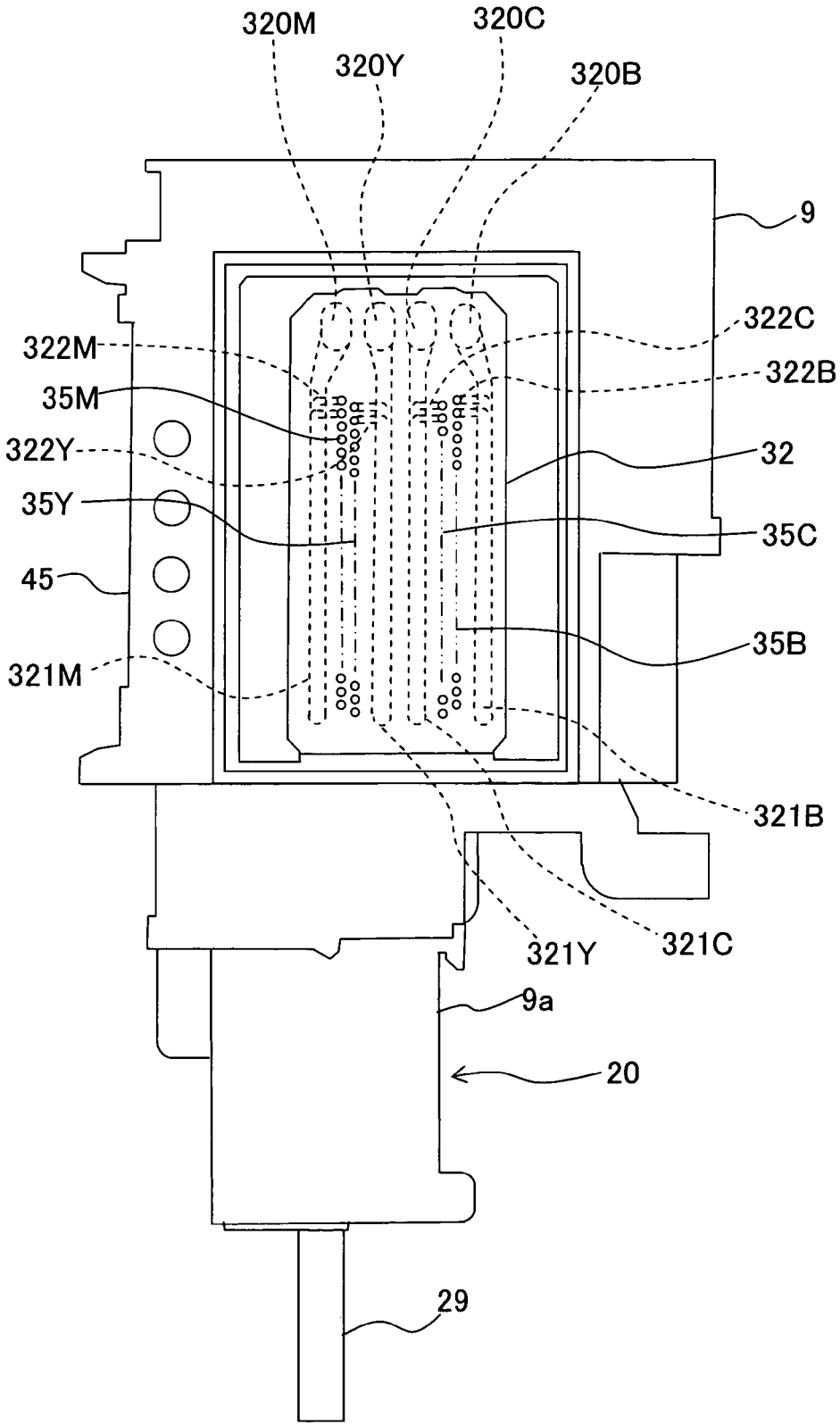
FIG. 4 is an explanatory view of the head holder in FIG. 3 viewed from its surface having nozzles (nozzle surface)

As shown in FIG. 2, the head holder 9 has a substantially box shape with an upper side open. The head holder 9 scan-moving relative to the recording paper P holds the recording head 30 on its bottom wall 9*c*. The recording head 30 includes: a cavity unit 32 having a plurality of nozzles 35 formed in a lower surface (nozzle surface) thereof; a piezoelectric actuator 31 applying a jetting pressure selectively to the inks in the cavity unit 32; and a flexible wiring (FPC) 36 with flexibility electrically joined to an upper surface of the piezoelectric actuator 31. As shown in FIG. 4, in the recording head 30, a nozzle row 35B for the black ink, a nozzle row 35C for the cyan ink, a nozzle row 35Y for the yellow ink, and a nozzle row 35M for the magenta ink are formed along the scanning direction, and each of the nozzle rows has a plurality of nozzles 35 arranged in a direction perpendicular to the scanning direction. In the cavity unit 32, common ink chambers 321M, 321Y, 321C, 321B are formed corresponding to the nozzle rows, respectively, and in parallel to the nozzle rows. The inks are supplied to these common ink chambers 321M, 321Y, 321C, 321B from ink inlet ports 320M, 320Y, 320C, 320B (to be described later), respectively. In the cavity unit 32, ink pressure chambers 322M, 322Y, 322C, 322B are formed corresponding to each of the nozzles 35 respectively; and the ink pressure chambers for each of the ink colors communicate with one common ink chamber among the common ink chambers and corresponding to the same ink color. The FPC 36 extends from the upper surface of the piezoelectric actuator 31 in a direction orthogonal to the nozzle rows and a driving circuit 37 is mounted thereon in parallel to the nozzle rows. The driving circuit 37 is formed as an IC chip and supplies a driving voltage selectively to deformable portions of the piezoelectric actuator 31, corresponding to the ink pressure chambers respectively. When each of the deformable portions of the piezoelectric actuator 31 is driven, the ink is jetted toward a recording medium from one of the nozzle rows 35 corresponding thereto.

Figure 11:
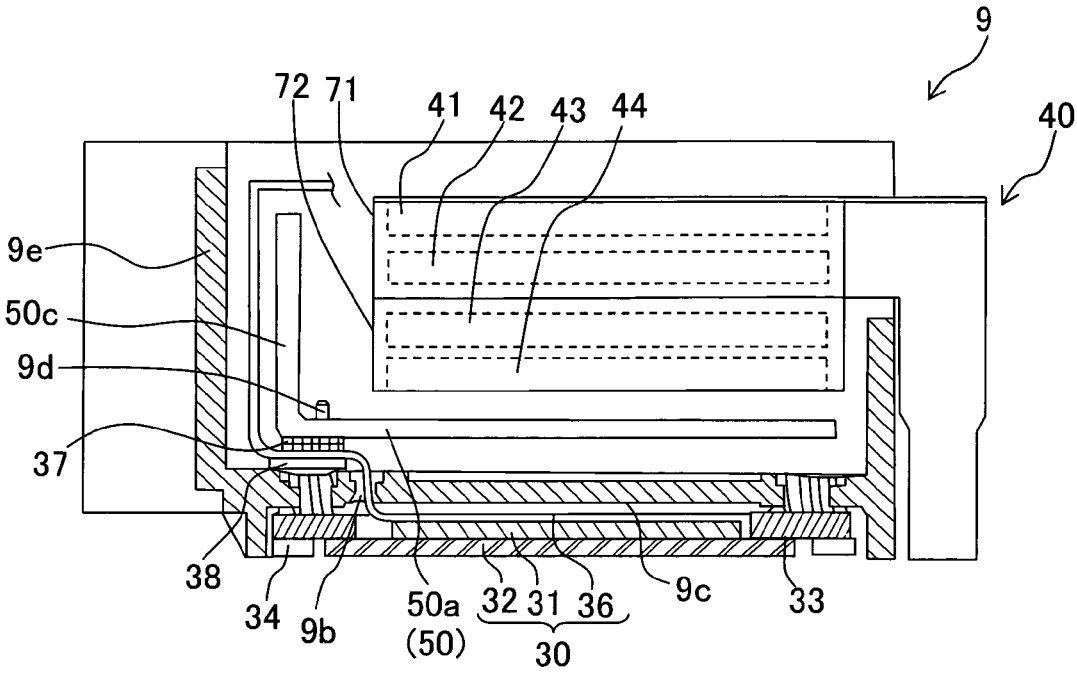
FIG. 11 is a sectional side view of the head holder 9.

On an upper surface of the recording head 30, a reinforcing frame 33 in a rectangular shape is bonded, and on a lower surface of the recording head 30, a frame 34 in a rectangular shape is bonded. In an upper surface of the cavity unit 32, the ink inlet ports 320M, 320Y, 320C, 320B are formed for the color inks, respectively; and these ink inlet ports 320M, 320Y, 320C and 320B communicate with ink passage ports 33M, 33Y, 33C, 33B, respectively, which are formed in an end portion of the reinforcing frame 33. As shown in FIG. 11, one end of the FPC 36 is joined to the piezoelectric actuator 31 and the other end of the FPC 36 is inserted in a through hole 9*b* formed in the bottom wall 9*c* of the head holder 9. Further, the driving circuit 37 arranged on the FPC 36 is in contact with a heat transfer plate 50 (to be described later on) in a heat conductive manner, the heat transfer plate 50 being fixed to a projection 9*d* of the head holder 9.

At a position above the recording head 30, the ink tank 40 storing the inks is disposed as an ink supply member supplying the inks to the recording head 30. Details of the ink tank 40 will be explained later. The ink tank 40 includes a plurality of ink storage chambers having flexible films (films 81 to 84 which will be described later). The flexible films damp or attenuate an impact force generated in the inks due to the movement and stop of the head holder 9. That is, the flexible films function as damper devices which prevent pressure fluctuation in the cavity unit 32, thereby maintaining uniform jetting performance of the nozzles 35. Air, which is separated from the inks in an amount of not less than a prescribed amount, is discharged or exhausted to the outside of the ink tank 40 by a discharge unit 4 provided in the ink tank 40. The discharge unit 45, similarly to that described in U.S. Patent Application Publication No. US2005/088494A1 (corresponding to Japanese Patent Application Laid-open No. 2005-125635), closes a valve to shut the ink storage chambers with respect to the outside of thereof in a normal state, while opening the valve to discharge the air when necessary. Further in an end portion of the ink tank 40, ink lead-in ports 22B, 22C, 22Y, 22M are formed, and the four tubes 14B, 14C, 14Y and 14M extending from the ink cartridges 5B, 5C, 5Y and 5M, respectively, are connected to the ink lead-in ports 22B, 22C, 22Y and 22M, respectively, whereby the inks are taken into the ink tank 40.

Figure 5:
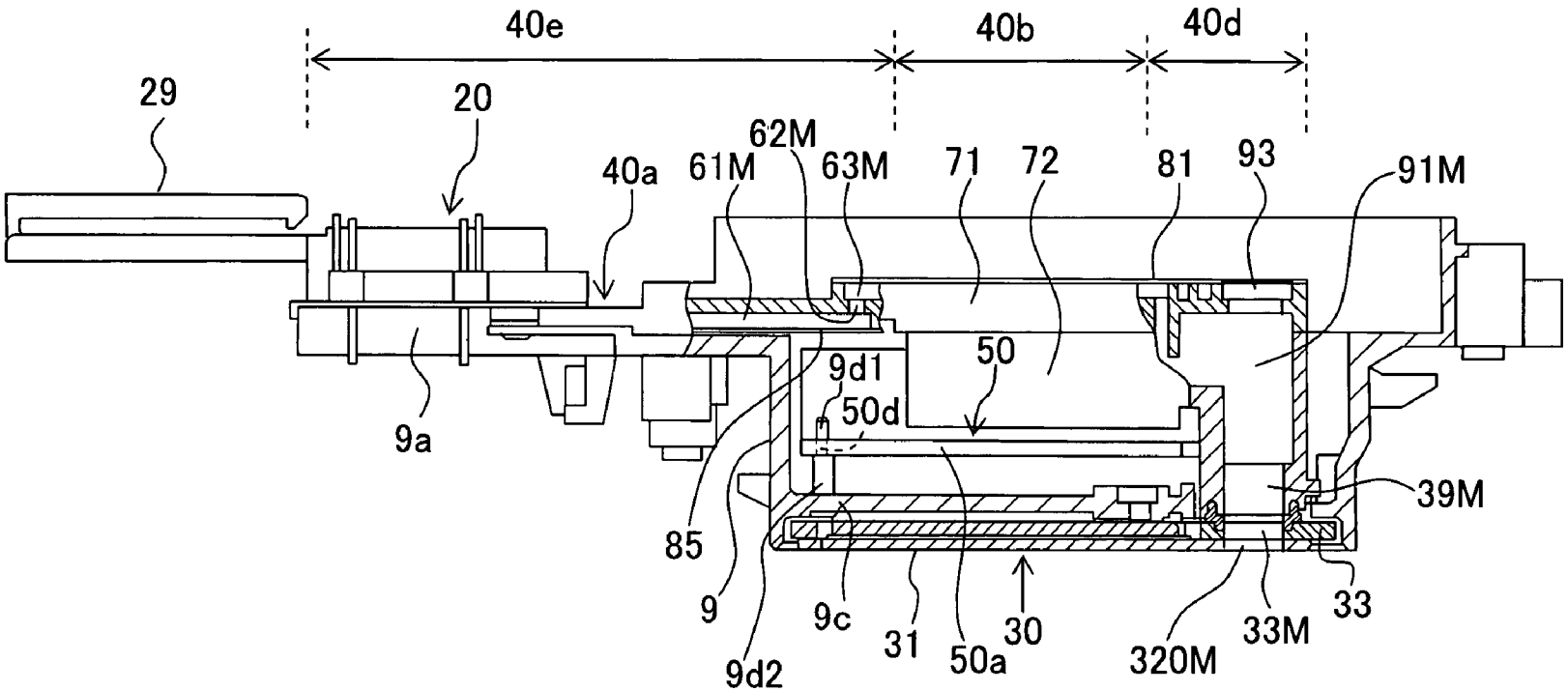
FIG. 5 is a cross-sectional view taken along line V-V in FIG. 3.

The ink tank 40 will be explained in detail by using FIG. 3 to FIGS. 10A to 10B. As shown in FIG. 5, the head holder 9 houses or accommodates the ink tank 40 on the bottom wall 9*c* thereof. The ink tank 40 includes an upper ink case 71 and a lower ink case 72 which are disposed in parallel to each other and which are joined in the up and down direction. In a front and back direction, the ink tank 40 is divided into an ink lead-in portion 40*e*, a damper portion 40*b*, and an ink lead-out portion 40*d*. As shown in FIGS. 10A to 10D, in the damper portion 40*b*, a wall 71*c* is provided in the upper ink case 71 to divide the upper ink case 71 into an upper surface side and a lower surface side, and a magenta ink storage chamber 41 (see FIG. 7A) storing the magenta ink and a black ink storage chamber 42 (see FIG. 7B) storing the black ink are disposed on the upper side and the lower side, respectively, via the wall 71*c*, and these ink storage chambers 41, 42 are adjacent to each other in the up and down direction.

As shown in FIGS. 10A to 10D, in the lower ink case 72, a wall 72*c* dividing the lower ink case 72 into an upper surface side and a lower surface side is provided. A cyan ink storage chamber 43 (see FIG. 8A) storing the cyan ink and a yellow ink storage chamber 44 (see FIG. 8B) storing the yellow ink are arranged on the upper side and the lower side, respectively, via the wall 72*c*, and these ink storage chambers 43, 44 are adjacent in the up and down direction.

That is, the magenta ink, the black ink, the cyan ink, and the yellow ink are stored in the ink tank 40 in this order from the top. The ink lead-out portion 40*d* includes ink lead-out channels 91M, 91B, 91C, 91Y in number corresponding to the aforesaid ink storage chambers 41 to 44, and at a portion behind the damper portion 40*b*, the ink lead-out channels 91M, 91B, 91C, 91Y are arranged in the scanning direction of the recording head (ink-jet head) 30 in an order corresponding to the order in which the nozzle rows for the inks of the respective colors are arranged. For example, as shown in FIG. 5 (FIG. 5 shows a situation for magenta ink as an example), the ink lead-out channels 91M, 91B, 91C and 91Y extend in the up and down direction along the upper and lower ink cases 71, 72; and ink supply ports 39M, 39B, 39C, 39Y are formed on lower ends of the ink lead-out channels 91M, 91B, 91C and 91Y, respectively. The ink lead-out channels 91M, 91B, 91C and 91Y communicate with the ink inlet ports 320M, 320B, 320C and 320Y, respectively, of the recording head 30 via the ink passage ports 33M, 33B, 33C and 33Y, respectively, of the reinforcing frame 33.

As shown in FIGS. 7A, 7B, 8A, 8B, and 10A to 10D, the ink lead-out channels 91M, 91B, 91C and 91Y are formed or demarcated for the respective ink colors by partition walls 40*g* which divide insides of cylindrical walls 40*k*, 40*f* formed in the upper and lower ink cases 71, 72 respectively. The cylindrical wall 40*k* and the partition walls 40*g* of the upper ink case 71 are joined to the cylindrical wall 40*f* and the partition walls 40*g* of the lower ink case 72 by ultrasonic welding, bonding, or the like, so that the ink lead-out channels 91M to 91Y are formed continuously along the upper and lower ink cases 71, 72 and at the same time, the upper and lower ink cases 71, 72 are mutually joined to be integrated together.

Figure 6:
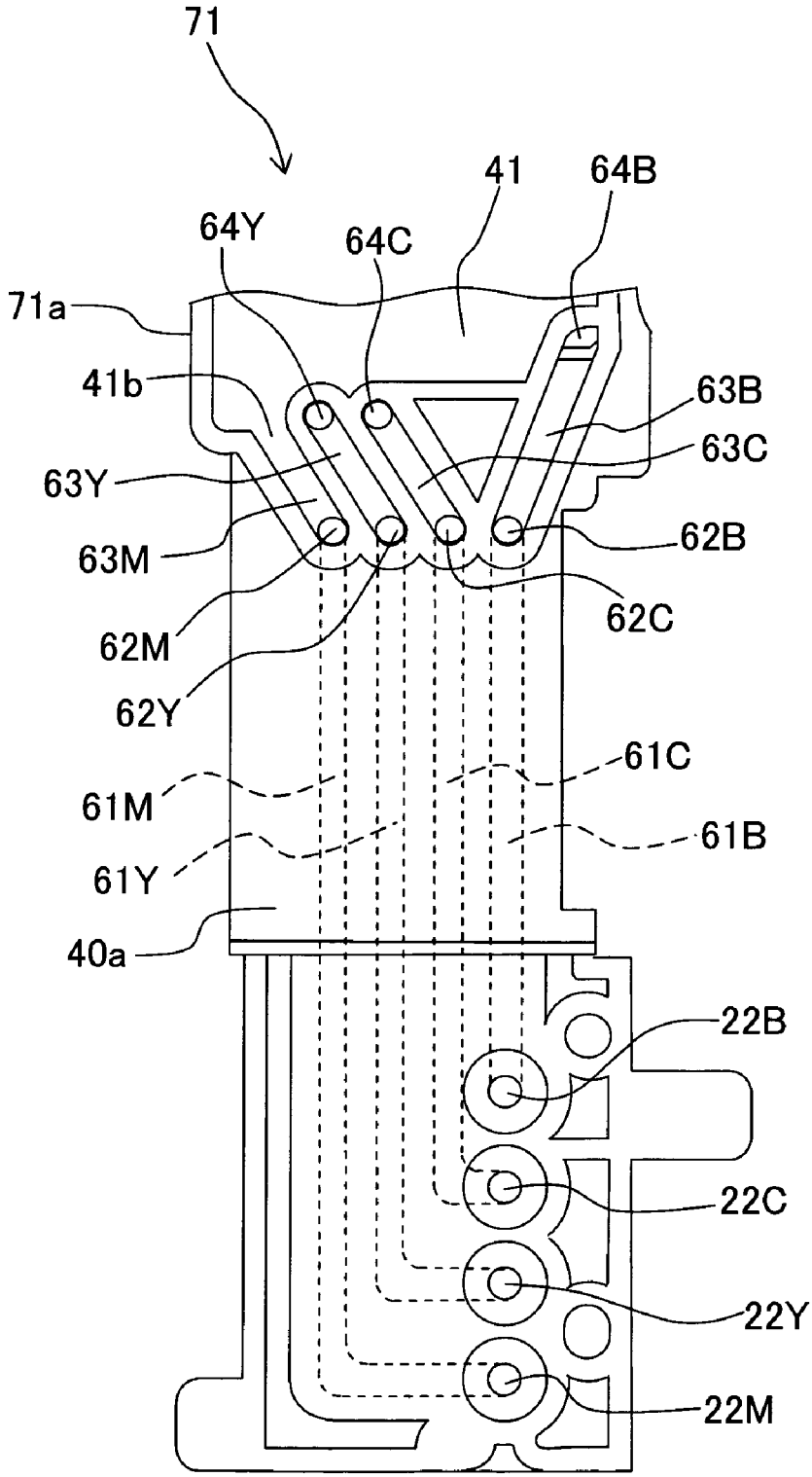
FIG. 6 is a plan view showing ink channels of a lead-in portion of an ink tank 40 shown in FIG. 3.

As shown in FIGS. 5 and 6, the ink lead-in portion 40*e* includes an extension portion 40*a* extending to a front side of the damper portion 40*b*. As shown in FIG. 5, the extension portion 40*a* is overlapped with and supported by a mounting arm portion 9*a* horizontally extending forward from a front end of the head holder 9. On a front upper surface of the extension portion 40*a*, a tube joint 20 is attached. A cable holding member 29, for holding the FPC 36 (not shown in FIG. 5), and through which the FPC 36 is inserted in the left and right direction is integrally formed on a front end of the tube joint 20.

Figure 3:
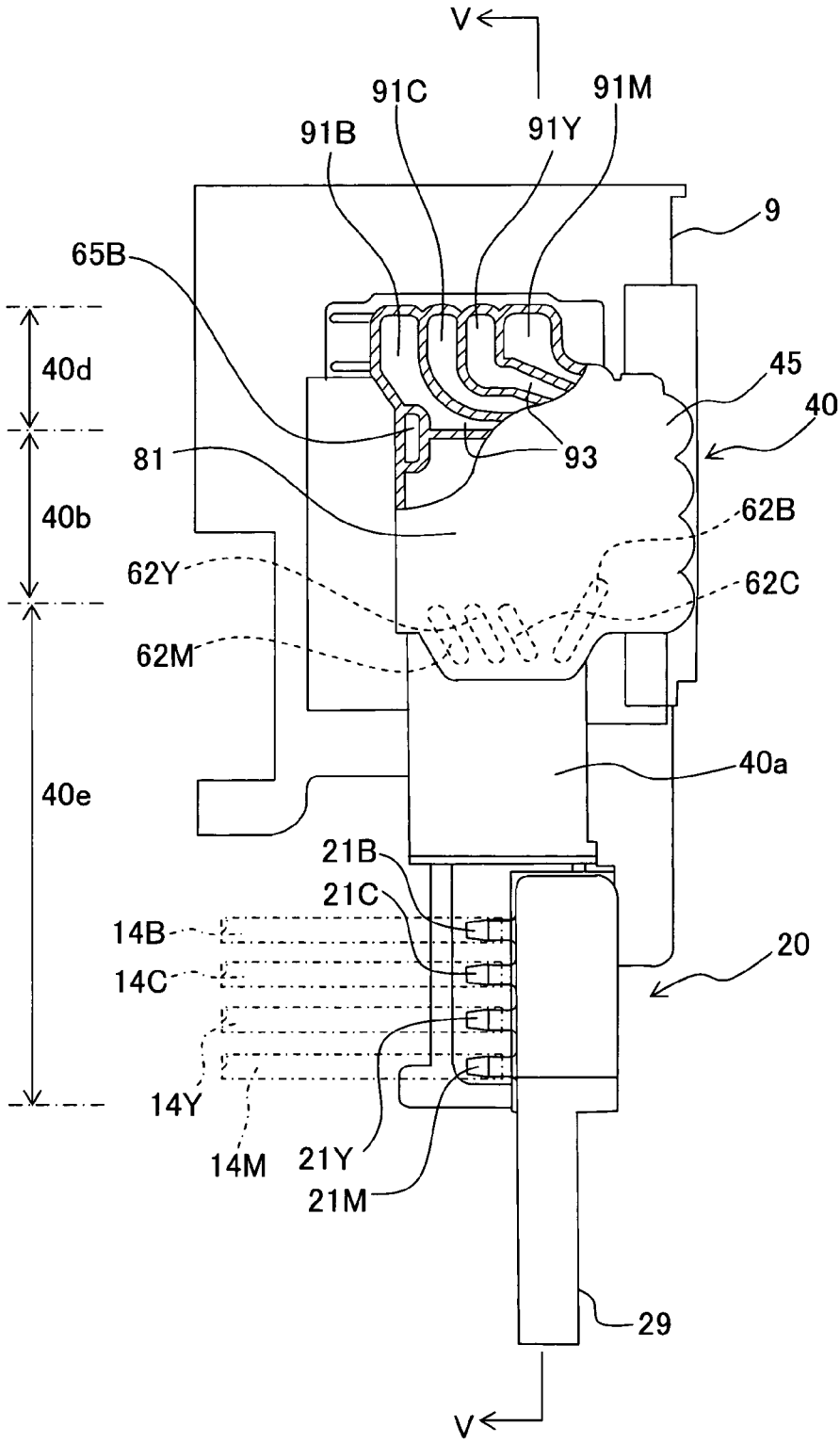
FIG. 3 is a plan view of the head holder.

As shown in FIG. 3, on the tube joint 20, connection portions 21B, 21C, 21Y, 21M to which the tubes 14B, 14C, 14Y, 14M are connected, respectively, are arranged in a line in a front and back direction, each protruding leftward. In the connection portions 21B, 21C, 21Y, 21M, the ink channels through which the inks are led in from the connected tubes are formed respectively.

As shown in FIG. 6, on an upper surface of the extension portion 40*a* corresponding to a lower surface of the tube joint 20, the ink lead-in ports 22B, 22C, 22Y, 22M communicating with the ink channels formed in the connection portions 21B, 21C, 21Y, 21M (see FIG. 3) are arranged in a line from a back side toward a front side.

On a lower surface of the extension portion 40*a*, formed are ink lead-in channels 61B, 61C, 61Y, 61M of which front ends are connected to the ink lead-in ports 22B, 22C, 22Y, 22M respectively. The ink lead-in channels 61B, 61C, 61Y, 61M are formed as grooves extending in the front and back direction and are arranged in the left and right direction on the lower surface of the extension portion 40*a*.

Openings of the ink lead-in channels 61B to 61M are sealed with a film 85 (see FIGS. 10A to 10D). The film 85 serves as bottoms of the grooves, and the grooves and the film 85 form the ink lead-in channels 61B to 61M.

As shown in FIGS. 10A to 10D, the extension portion 40*a* is integrally connected to the wall 71*c*, and back ends of the ink lead-in channels 61B, 61C, 61Y and 61M are connected to ink lead-in channels 63B, 63C, 63Y, 63M, respectively, via ink lead-in holes 62B, 62C, 62Y, 62M penetrating through the extension portion 40*a* in the up and down direction.

As will be described later, the ink lead-in channel 61M and the ink lead-in channel 61B on the left end and the right end respectively in FIG. 6 are connected to the magenta ink storage chamber 41 and the black ink storage chamber 42, respectively, in the upper ink case 71; and the center ink lead-in channels 61C, 61Y are connected to the cyan ink storage chamber 43 and the yellow ink storage chamber 44, respectively, in the lower ink case 72.

Figure 10A:
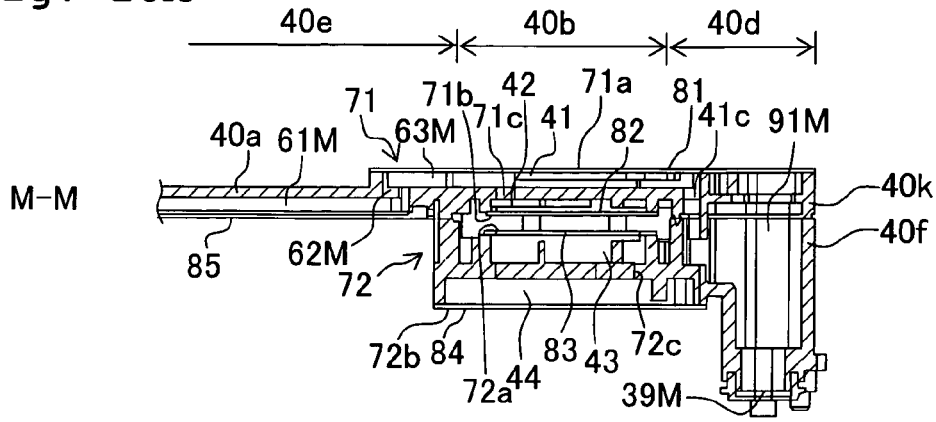
FIG. 10A is a cross-sectional view taken along XA-XA (M-M) line in FIG. 9.
Figure 10B:
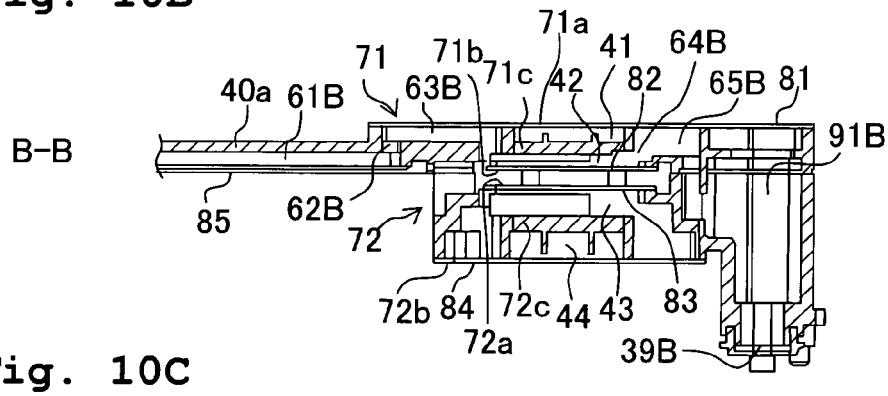
FIG. 10B is a cross-sectional view taken along XB-XB (B-B) line in FIG. 9.
Figure 10C:
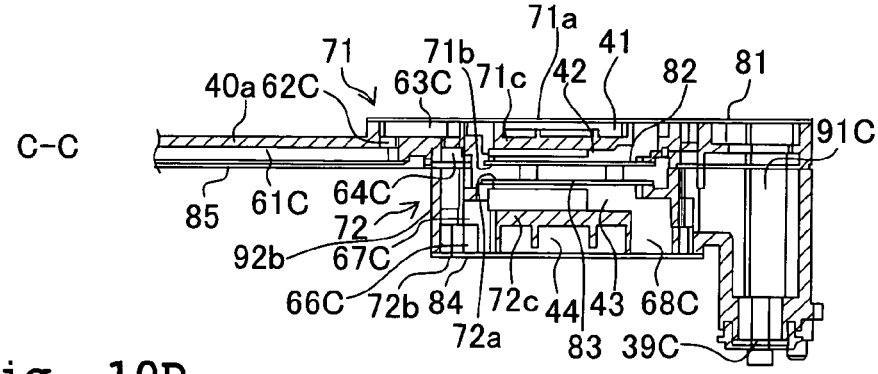
FIG. 10C is a cross-sectional view taken along XC-XC (C-C) line in FIG. 9.
Figure 10D:
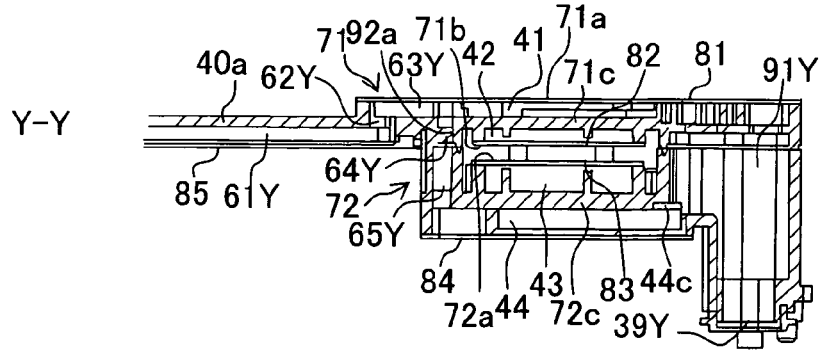
FIG. 10D is a cross-sectional view taken along XD-XD (Y-Y) line in FIG. 9.

As shown in FIGS. 10C, 10D, at positions, in the ink cases 71, 72, overlapping in a plan view with the center ink lead-in channels 63Y, 63C respectively, cylindrical walls 92*a*, 92*b* are formed respectively, and upper ends of ink lead-in channels 64Y, 64C defined by the cylindrical walls 92*a*, 92*b* are connected to back ends of the ink lead-in channels 63Y, 63C, respectively.

The cylindrical walls 92*a*, 92*b* are joined together by ultrasonic welding, bonding, or the like, so that the ink lead-in channels 63Y, 63C of the upper ink case 71 are connected to the ink storage chambers 43, 44 of the lower ink case 72 via the ink lead-in channels 64Y, 64C, and at the same time, the aforesaid cylindrical walls are joined together, so that the upper and lower ink cases 71, 72 are mutually connected to be integrated together.

Figure 7A:
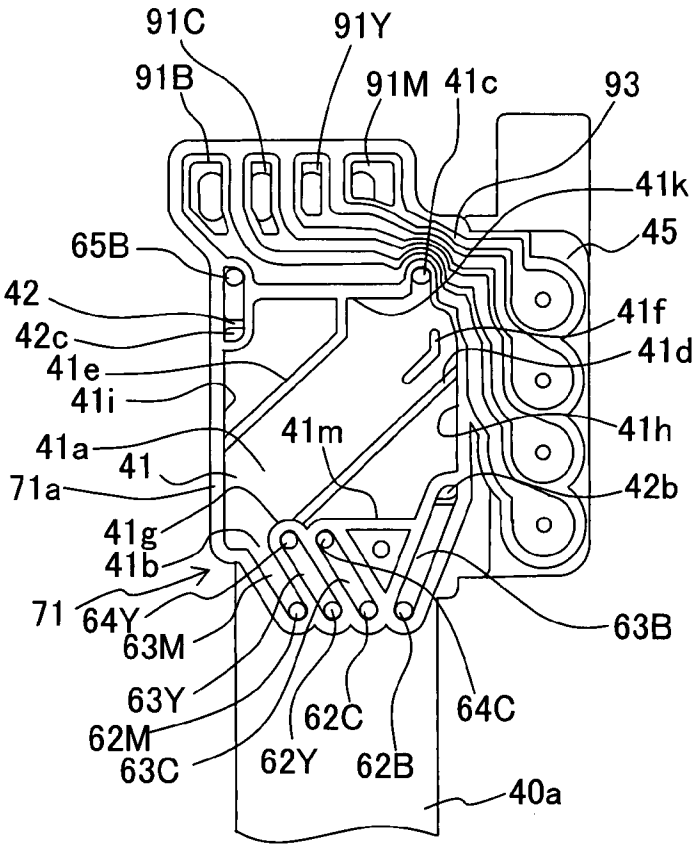
FIG. 7A is a plan view showing an upper ink case 71 viewed from an upper side.

Next, the major structure of the ink storage chambers 41 to 44 will be explained with reference to the drawings. First, the structure of the magenta ink storage chamber 41 will be explained. As shown in FIG. 10A, in the damper portion 40*b*, the magenta ink storage chamber 41 which has a substantially quadrangular horizontal cross section and of which upper surface is open in the same shape is formed on an upper surface of the wall 71*c* of the upper ink case 71. As shown in FIG. 7A, peripheral four sides of the magenta ink storage chamber 41 are defined by a left wall 41*i*, a right wall 41*h*, a back wall 41*k*, and a front wall 41*m*. In the ink storage chamber 41, the back end of the ink lead-in channel 63M is open, as an ink entrance 41*b*, at a corner portion formed by the left wall 41*i* and the front wall 41*m*.

A magenta ink exit 41*c* from which the magenta ink in the magenta ink storage chamber 41 flows out is formed of the back wall 41*k* at a position rightward in the left and right direction, the position being close to a back right corner of the magenta ink storage chamber 41, and slightly protruding backwardly from the back wall 41*k*.

That is, the magenta ink entrance 41*b* and the magenta ink exit 41*c* are provided at substantially diagonal positions in the magenta ink storage chamber 41. In other words, the magenta ink entrance 41*b* and the magenta ink exit 41*c* are formed at positions that are substantially farthest or most distant from each other in the magenta ink storage chamber 41.

Figure 7B:
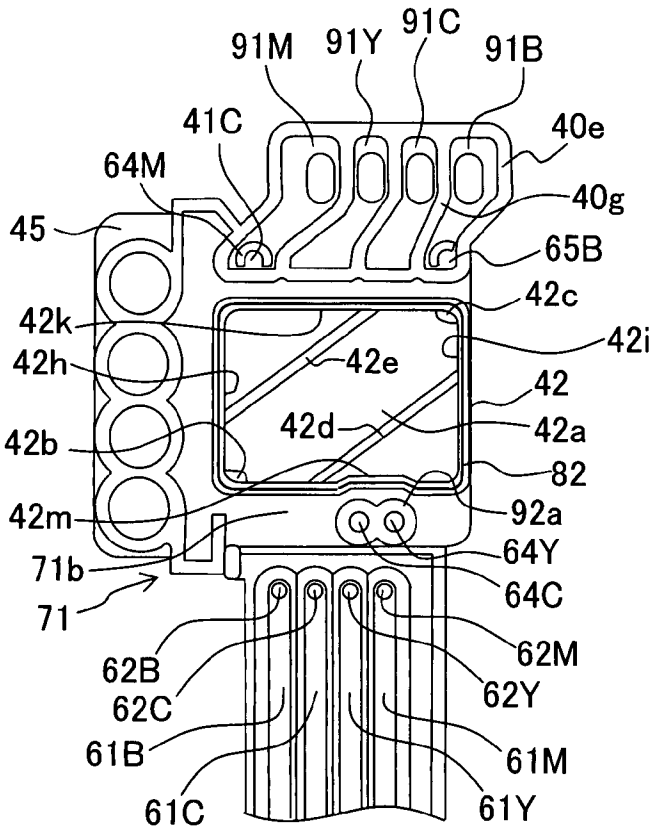
FIG. 7B is a plan view showing the upper ink case 71 viewed from a lower side.

The magenta ink exit 41*c* is formed to penetrate, from a bottom surface of the magenta ink storage chamber 41, to a lower surface 71*b* (FIG. 7B) of the upper ink case 71 and is connected to the ink lead-out channel 91M (FIG. 7B, FIG. 10A). A guide wall 64M surrounds and partitions a periphery of a lower surface of the ink exit 41*c*, on a side of the ink lead-out channel 91M, so as to guide the ink to a bottom of the ink lead-out channel 91M. Note that, between the magenta ink storage chamber 41 and the yellow ink storage chamber 44, the ink lead-out channels 91M, 91Y, 91C to 91B extend forward so as to overlap with the magenta ink exit 41*c* and the yellow ink exit 44*c* in the up and down direction.

In the magenta ink storage chamber 41 and the ink lead-in channels 63M, 63B, 63C, 63Y, surfaces thereof which are open upward are sealed with a flexible film 81 (FIG. 3, FIG. 10A); and in a connection lead-out channel 65B and a discharge channel 93 (to be described later) also, surfaces thereof which are open upward are sealed with the flexible film 81. Upper surfaces, of sidewalls defining outer peripheries of the ink lead-in channels 63M, 63B, 63C, 63Y and a connection lead-out channel 65B and a discharge channel 93 (to be described later) are flush with (formed in a same plane as) upper surfaces of sidewalls 41*h* to 41*m* of the magenta ink storage chamber 41; and the film 81 is joined to these upper surfaces by bonding, thermal welding, or the like. In this manner, the magenta ink storage chamber 41 and the ink lead-in channels as described above and a connection lead-out channel 65B and discharge channel 93 (to be described later) are defined or demarcated, respectively.

On a bottom 41*a* of the magenta ink storage chamber 41, ribs 41*d*, 41*e*, 41*f* are provided in an upright manner with a spacing distance on both sides of a line connecting the magenta ink entrance 41*b* and the magenta ink exit 41*c*. The rib 41*d* and the rib 41*e* each have a quadrangular vertical cross section. Since each of the rib 41 and the rib 41*e* has a height about half a depth of the magenta ink storage chamber 41 (distance from the film 81 to the bottom 41*a*) and a gap is defined between the film 81 and each of the ribs 41*d*, 41*e*, the rib 41*d* and the rib 41*e* do not restrict the movement of the film 81. The rib 41*d* and the rib 41*e* guide the ink so that the ink quickly flows from the ink entrance 41*b* to the ink exit 41*c*. In addition, the rib 41*f* constructed of a small piece having a bent portion is formed between the rib 41*d* and the rib 41*e* so as to guide the flow of the ink toward the ink exit 41*c*.

Next, the black ink storage chamber 42 will be explained with reference to FIG. 7B. Since FIG. 7B shows the upper ink case 71 viewed from a lower side, the left direction of the drawing is "the right direction" and the right direction of the drawing is "the left direction".

As shown in FIG. 7B, on a lower surface of the wall 71*c* of the upper ink case 71, the black ink storage chamber 42 which has a substantially quadrangular horizontal cross section and of which lower surface is open is formed. The black ink storage chamber 42 is demarcated or partitioned by a left wall 42*i*, a right wall 42*h*, a back wall 42*k*, and a front wall 42*m*, and is provided adjacent to the magenta ink storage chamber 41 in the up and down direction, via the wall 71*c*, as shown, for example, in FIG. 10B.

A black ink entrance 42*b* of the black ink storage chamber 42 is formed near a right front corner of a bottom 42*a* in the black ink storage chamber 42 and penetrates through the upper ink case 71 to be connected to one end of the ink lead-in channel 63B (FIG. 7A).

A black ink exit 42*c* of the black ink storage chamber 42 is formed near a left back corner of the bottom 42*a* to penetrate through the ink case 71, and is formed at a position diagonal to the black ink entrance 42*b*. A connection lead-out channel 65B is formed on an upper surface 71*a* of the upper ink case 71, at a position corresponding to the black ink exit 42*c*. One end of the connection lead-out channel 65B is connected to the black ink exit 42*c* penetrating through the upper ink case 71, and the other end of the connection lead-out channel 65B is connected to the black ink lead-out channel 91B penetrating through the upper ink case 71 from the upper surface to the lower surface.

The black ink entrance 42*b* and the black ink exit 42*c* are provided of the black ink storage chamber 42 at substantially diagonal positions thereof. In other words, the black ink entrance 42*b* and the black ink exit 42*c* are formed at positions which are the farthest or the most distant from each other in the black ink storage chamber 42.

That is, the black ink entrance 42*b* and the black ink exit 42*c* are formed at positions which are substantially the most distant from each other across most of a space where the ink flows in the black ink storage chamber 42.

Further, the magenta ink storage chamber 41 and the black ink storage chamber 42 are in a positional relationship in which they are adjacent to each other in the up and down direction via the wall 71*c* of the upper ink case 71, and the entrance 41*b* and exit 41*c* for the magenta ink and the entrance 42*b* and exit 42*c* for the black ink are disposed at positions mutually different from each other along the wall 71*c*. That is, in a plan view of the upper ink case 71, a line connecting the magenta ink entrance 41*b* and exit 41*c* and a line connecting the black ink entrance 42*b* and exit 42*c* intersect with each other substantially like diagonals in different directions.

An opening, of the black ink storage chamber 42, which is open downwardly is sealed with a flexible film 82 (FIG. 10B). The film 82 is joined to sidewalls 42*h* to 42*m* of the ink storage chamber 42 by bonding, thermal welding, or the like, whereby the ink storage chamber 42 is demarcated.

On the bottom 42*a* of the black ink storage chamber 42, ribs 42*d*, 42*e* are provided in an upright manner. The ribs 42*d*, 42*e* are provided in parallel to the direction of the diagonal connecting the black ink entrance 42*b* and the black ink exit 42*c* and are substantially equally distant from the diagonal. The rib 42*d* and the rib 42*e* each have a quadrangular vertical cross section. Since each of the rib 42*d* and the rib 42*e* has a height about half a depth of the black ink storage chamber 42 (distance from the film 82 to the bottom 42*a*) and a gap is defined between the film 82 and each of the ribs 42*d* and 42*e*, the rib 42*d* and the rib 42*e* do not restrict the movement of the film 82. The rib 42*d* and the rib 42*e* guide the ink so that the ink quickly flows from the ink entrance 42*b* to the ink exit 42*c*.

The cyan ink storage chamber 43 will be explained with reference to FIG. 8A and FIG. 8B. Since FIG. 8B shows the lower ink case 72 from a lower side, the left direction of the drawing is "the right direction" and the right direction of the drawing is "the left direction".

Figure 8A:
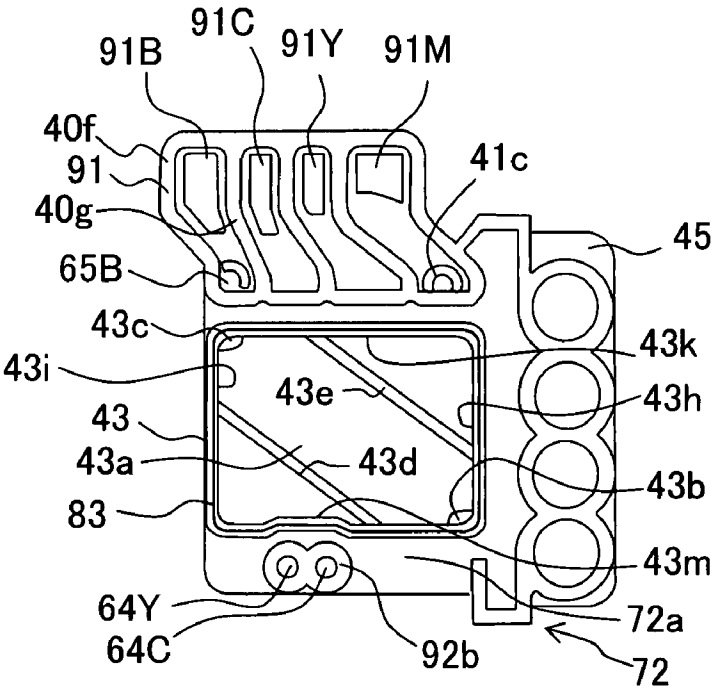
FIG. 8A is a plan view of a lower ink case 72 viewed from an upper side.
Figure 8B:
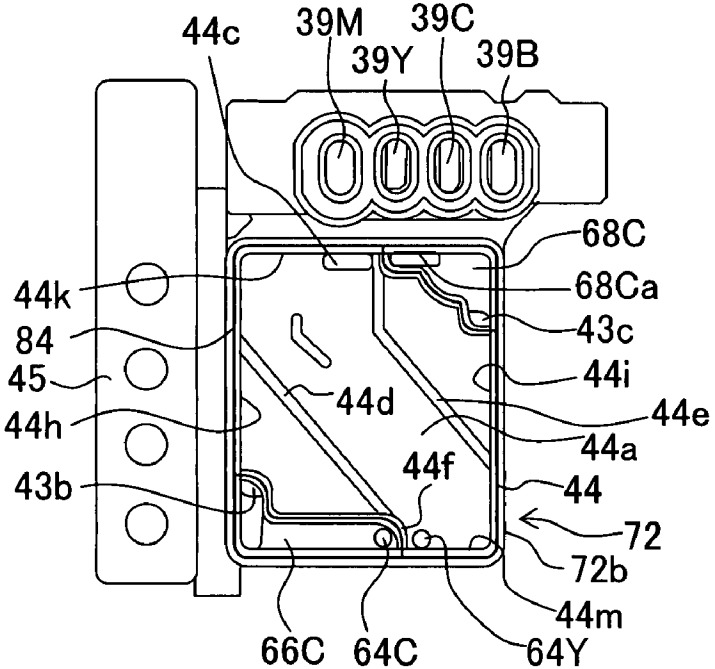
FIG. 8B is a plan view of the lower ink case 72 viewed from a lower side.

As shown in FIG. 8A, on an upper surface 72*a* of the lower ink case 72, the cyan ink storage chamber 43, having the same shape as the shape of the black ink storage chamber 42 and demarcated by a left wall 43*i*, a right wall 43*h*, a back wall 43*k*, and a front wall 43*m*, is formed at a position corresponding to the black ink storage chamber 42. The cyan ink storage chamber 43 is open upwardly. On a bottom 43*a*, ribs 43*d*, 43*e* in the same shape as the shape of the ribs 42*d*, 42*e* (FIG. 7B) are provided in an upright manner.

The opening of the cyan ink storage chamber 43 is sealed with a flexible film 83 in a substantially rectangular shape, similarly to the opening of the black ink storage chamber 42.

That is, the upper ink case 71 and the lower ink case 72 are connected to each other, with the film 82 of the black ink storage chamber 42 and the film 83 of the cyan ink storage chamber 43 facing in parallel to each other at a certain gap.

A cyan ink entrance 43*b* of the cyan ink storage chamber 43 is formed near a right front corner of the bottom 43*a* of the cyan ink storage chamber 43 and penetrates through the lower ink case 72 in a thickness direction to be connected to one end of an ink lead-in channel 66C formed on a lower surface of the lower ink case 72. The ink lead-in channel 66C is formed outside the yellow ink storage chamber 44 and has an L-shape along the right front corner of the yellow ink storage chamber 44, and the other end of the ink lead-in channel 66C is connected to a lower end of the ink lead-in channel 64C.

That is, the ink lead-in channel 63C (FIG. 7A) formed on the upper surface 71*a* of the upper ink case 71 communicates with the cyan ink entrance 43*b* of the cyan ink storage chamber 43 via the ink lead-in channel 64C (FIG. 7B), which penetrates through the upper ink case 71 and the lower ink case 72 in a direction in which the cases 71 and 72 are stacked (stacking direction), and via the ink lead-in channel 66C.

A cyan ink exit 43*c* of the cyan ink storage chamber 43 is formed near a left back corner of the bottom 43*a* of the cyan ink storage chamber 43, and penetrates through the lower ink case 72 in the thickness direction to be connected to a connection lead-out channel 68C (FIG. 8B) formed on the lower surface of the lower ink case 72. As shown in FIG. 8B, the connection lead-out channel 68C is formed outside the yellow ink storage chamber 44 and has a L-shape along a left back corner of the yellow ink storage chamber 44. The connection lead-out channel 68C and back portions of the yellow ink storage chamber 44 are positioned so as to overlap with the ink lead-out channels 91M, 91Y, 91C and 91B in a plan view, and the other end 68Ca of the connection lead-out channel 68C penetrates through the lower ink case 72 from the lower side to the upper side to be connected to the ink lead-out channel 91C.

The yellow ink storage chamber 44 will be explained with reference to FIG. 8B.

As shown in FIG. 8B, in a lower portion of the lower ink case 72, the yellow ink storage chamber 44 which has a substantially quadrangular horizontal section and which is open downwardly at a lower surface thereof is formed. The yellow ink storage chamber 44 is demarcated by a left wall 44*i*, a right wall 44*h*, a back wall 44*k*, and a front wall 44*m*, and is provided adjacent to the cyan ink storage chamber 43 in the up and down direction, via the wall 72*c*, as shown in FIGS. 10A to 10D.

The ink lead-in channel 66C and the connection lead-in channel 68C for the cyan ink are formed at positions adjacent to a right front corner and the left back corner, respectively, of the yellow ink storage chamber 44.

A front portion of the yellow ink storage chamber 44 overlaps with the ink lead-in channel 64Y in a plan view, and the ink lead-in channel 64Y penetrates through the lower ink case 72 in the up and down direction to form an opening near the left front corner of a bottom 44*a* of the yellow ink storage chamber 44. That is, the lower end opening of the ink lead-in channel 64Y is an ink entrance 44*b* of the yellow ink storage chamber 44.

A yellow ink exit 44*c* from which the yellow ink in the yellow ink storage chamber 44 flows out is formed in the bottom 44*a* in the back wall 44*k* at a position slightly rightward from the center in the left and right direction, and the ink exit 44*c* penetrates through the lower ink case 72 in the up and down direction to communicate with the ink lead-out channel 91Y.

That is, the yellow ink entrance 44*b* and the yellow ink exit 44*c* are provided on the yellow ink storage chamber 44 substantially at diagonal positions thereof. In other words, the yellow ink entrance 44*b* and the yellow ink exit 44*c* are provided at positions which are substantially the farthest or the most distant from each other in the yellow ink storage chamber 44.

Further, the yellow ink storage chamber 44 and the cyan ink storage chamber 43 are in a positional relationship in which the chambers 44 and 43 adjacent to each other in the up and down direction, via the wall 72*c* of the lower ink case 72, and the entrance 44*b* and exit 44*c* for the yellow ink and the entrance 43*b* and exit 43*c* for the cyan ink are disposed at positions different from each other along the wall 72*c*.

That is, in a plan view of the lower ink case 72, a line connecting the cyan ink entrance 43*b* and exit 43*c* and a line connecting the yellow ink entrance 44*b* and exit 44*c* intersect with each other substantially like diagonals in different directions.

Openings, of the yellow ink storage chamber 44, ink lead-in channel 66C, and connection lead-out channel 68C which are open downwardly are sealed with a flexible film 84 (FIG. 8B, FIG. 10D). Lower surfaces of sidewalls demarcating or partitioning the ink lead-in channel 66C, the connection lead-out channel 68C, and the yellow ink storage chamber 44 are flush with one another (are formed in a same plane), and the film 84 is joined to these surfaces by bonding, thermal welding, or the like, whereby the yellow ink storage chamber 42, the ink lead-in channel 66C, and the connection lead-out channel 68C are demarcated or partitioned, respectively.

On the bottom 44*a* of the yellow ink storage chamber 44, ribs 44*d*, 44*e* are provided in an upright manner, at a certain spacing distance, on both sides, respectively, of the line connecting the ink entrance 41*b* and the ink exit 41*c*. The rib 42*d* and the rib 44*e* each have a quadrangular vertical cross section. Since each of the rib 42*d* and the rib 44*e* has a height about half a depth of the yellow ink storage chamber 44 (distance from the film 84 to the bottom 44*a*) and a gap is formed between the film 84 and each of the ribs 44*d*, 44*e*, the ribs 44*d*, 44*e* do not restrict the movement of the film 84. The rib 44*d* and the rib 44*e* guide the ink so that the ink quickly flows from the ink entrance 44*b* to the ink exit 44*c*.

Next, the flow of the inks will be explained. The magenta ink flows along a route shown in the cross section taken along the M-M line in FIG. 9. As shown in FIG. 10A, the magenta ink flows through the ink lead-in channels 61M, 63M from the ink lead-in port 22M (FIG. 6) and is led into the magenta ink storage chamber 41 from the magenta ink entrance 41*b* (FIG. 7A).

As shown in FIG. 7A, the magenta ink led into the magenta ink storage chamber 41 flows from the magenta ink entrance 41*b* toward the magenta ink exit 41*c* in the magenta ink storage chamber 41. As shown in FIG. 10A, the magenta ink flowing out of the magenta ink storage chamber 41 is led to the ink supply port 39M via the ink lead-out channel 91M, and as shown in FIG. 5, flows through the ink passage port 33M of the reinforcing frame 33 to be supplied from the ink inlet port 320M to the nozzle row 35M (FIG. 4), which is one of the outermost nozzle rows (the nozzle rows disposed outermostly), of the recording head 3.

Figure 9:
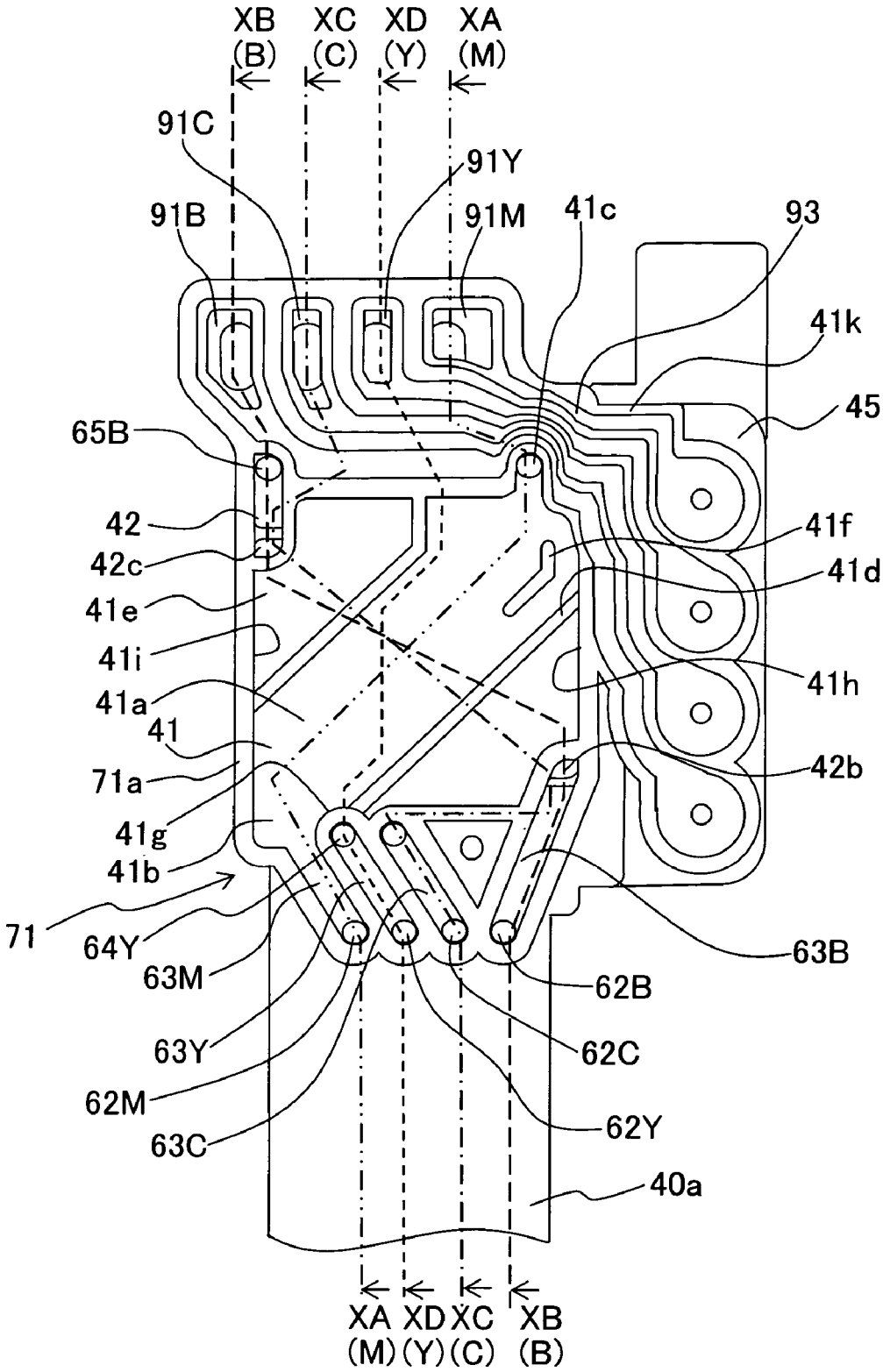
FIG. 9 is an enlarged plan view of the upper ink case 71 viewed from the upper side.

The black ink flows along a route shown in the cross section taken along the B-B line in FIG. 9. As shown in FIG. 10B, the black ink flows through the ink lead-in channels 61B, 63B from the ink lead-in port 22B (FIG. 6) and is led into the black ink storage chamber 42 on the lower side of the upper ink case 71 from the black ink entrance 42*b* (FIG. 7B).

As shown in FIG. 7B, the black ink led into the black ink storage chamber 42 flows from the black ink entrance 42*b* toward the black ink exit 42*c*. As shown in FIG. 10B, the black ink flowing out of the black ink storage chamber 42 is led to the ink supply port 39B through the ink lead-out channel 91B, and flows through the black ink passage port 33B to be supplied from the ink inlet port 320B to the nozzle row 35B (FIG. 4) which is the other of the outermost nozzle rows in the recording head 30.

The cyan ink flows along a route shown in the cross section taken along the C-C line in FIG. 9. As shown in FIG. 10C, the cyan ink led from the ink lead-in port 22C (FIG. 6) to the ink lead-in channels 61C, 63C flows into the ink lead-in channel 66C on the side of the lower surface of the lower ink case 72 through the ink lead-in channel 64 penetrating through the upper and lower ink cases 71, 72 in the stack direction, and thereafter is led into the cyan ink storage chamber 43 on the upper surface side in the lower case 72, from the cyan ink entrance 43*b* (FIG. 8A).

As shown in FIG. 8A, the cyan ink led into the cyan ink storage chamber 43 flows from the cyan ink entrance 43*b* toward the cyan ink exit 43*c*. As shown in FIG. 10C, the cyan ink flowing out of the cyan ink storage chamber 43 is led to the ink supply port 39C through the ink lead-out channel 91C and flows through the ink passage port 33C to be supplied from the ink inlet port 320C to the center nozzle row 35C (FIG. 4) of the recording head 30.

The yellow ink flows along a route shown in the cross section taken along the Y-Y line in FIG. 9. As shown in FIG. 10D, the yellow ink led from the ink lead-in port 22Y (FIG. 6) to the ink lead-in channels 61Y, 63Y flows into the yellow ink storage chamber 44 on the lower side of the lower ink case 72 through the ink lead-in channel 64Y penetrating through the upper and lower ink cases 71, 72 in the stacking direction.

As shown in FIG. 8B, the yellow ink led into the yellow ink storage chamber 44 flows from the yellow ink entrance 44*b* toward the yellow ink exit 44*c*. As shown in FIG. 10D, the yellow ink flowing out of the yellow ink storage chamber 44 is led to the ink supply port 39Y through the ink lead-out channel 91Y and flows through the ink passage port 33Y to be supplied from the ink inlet port 320Y to the center nozzle row 35Y of the recording head 30.

Next, returning to FIG. 2, the heat transfer plate 50 accommodated in the head holder 9 will be explained.

The heat transfer plate 50 is formed of a plate-shaped member made of highly heat-conductive metal (for example, an aluminum material). As shown in FIG. 2, the heat transfer plate 50 has a substantially quadrangular horizontal wall 50*a* and a sidewall 50*c* and is formed in an L-shape. As shown in FIG. 5, the heat transfer plate 50 is fixed in such a manner that holes 50*d* formed in the horizontal wall 50*a* are fitted to projections 9*d* on the bottom wall 9*c* of the head holder 9 and the projections 9*d* are thermally deformed. Each of the projections 9*d* has a tip portion 9*d*1 and a lower portion 9*d*2 larger in diameter than the tip portion 9*d*1 and thus has a stepped shape. The horizontal wall 50*a* which is a step surface of the lower portion 9*d*2 is formed in parallel to and between the bottom wall 9*c* and the yellow ink storage chamber 44 which is the lowest layer of the ink tank 40, and extends in the direction in which the nozzle rows are arranged. Further, as shown in FIG. 11, the sidewall 50*c* of the heat transfer plate 50 is arranged along a sidewall 9*e* of the head holder 9 and a side surface of the ink tank 40, with a spacing distance therefrom.

As shown in FIG. 11, the flexible wiring member 36 is inserted to and drawn out from the through hole 9*b* of the head holder 9 and passes along a lower surface of the horizontal wall 50*a* of the heat transfer plate 50 to pass between the sidewall 50*c* and the sidewall 9*e* of the head holder 9 and then is led out to the outside of the head holder 9. The driving circuit 37 on the flexible wiring member 36 is brought into contact with the heat transfer plate 50 in a heat conductive manner by a rubber resilient member (rubber elastic body) 38 sandwiched between the driving circuit 37 and the bottom wall 9*c*. Therefore, the heat transfer plate 50 is capable of releasing heat transferred from the driving circuit 37 to a space surrounded by the bottom wall 9*c* and the sidewall 9*e* of the head holder 9, and the ink tank 40.

The horizontal wall 50*a* of the heat transfer plate 50 is arranged with a spacing distance from the film 84 of the yellow ink storage chamber 44 so as not to interfere with the movement of the film 84. Furthermore, it is enough that the heat transfer plate 50 only faces an ink storage chamber positioned at one end in the direction in which the ink storage chambers in the ink tank 40 are arranged. Accordingly, the heat transfer plate 50 may be disposed, for example, on the upper side of the ink tank 40 to face and cover the magenta ink storage chamber 41 positioned on the uppermost layer of the ink storage chambers. In this case, the heat transfer plate 50 is arranged with a spacing distance from the film 81 so as not to interfere with the movement of the film 81. As for the shape of the heat transfer plate 50, since in this embodiment, the horizontal wall 50*a* has a substantially quadrangular shape and is arranged right under and along the entire surface of the ink tank 40, it cannot be avoided that much of the heat held by the heat transfer plate 50 is transferred to the ink tank 40. To adjust this heat transfer amount, part of a surface, of the horizontal wall 50*a*, facing the ink tank 40 may be cut. For example, a portion of the horizontal wall 50*a* close to the ink passage ports 33M to 33B may be cut out so as to limit an amount of the heat transferred from the horizontal wall 50*a* to the ink passage ports 33M to 33B.

With this construction, in the ink-jet recording apparatus jetting the color inks in the ink tank 40, the thermal influence from the driving circuit becomes largest on the low-visibility yellow ink and becomes relatively small on the high-visibility black ink. Further, since the heated yellow ink is supplied to the common ink chamber 321Y between the common ink chambers 321M, 321C of the magenta ink and the cyan ink in the recording head 30 as shown in FIG. 4, the heat of the yellow ink also heats the magenta ink and the cyan ink in the common ink chambers 321M, 321C located on both sides of the yellow ink chamber 321Y, thereby reducing the variation in temperature among the ink colors. Therefore, a printing error, if any, such as deviation from a landing position and variation in dot diameter of the ink in the light color is less conspicuous because of low visibility of the light color in spite of a large thermal influence given thereto. Further, since the high-visibility black ink is less likely to be affected by the thermal influence, deterioration in printing quality can be reduced, thereby realizing high-quality printing as a whole. Furthermore, since this allows an increase in size of the heat transfer plate 50 and allows the heat transfer plate 50 and the driving circuit 37 to be disposed close to the ink tank 40, a high heat release effect is achieved and the whole head holder can be made compact, thereby making it possible to provide a compact ink-jet recording apparatus.

In this embodiment, the inks of the four colors of yellow, magenta, black and cyan are used, and the ink storage chamber arranged to face the heat transfer plate 50 stores the lowest-visibility yellow ink, and the ink storage chambers of magenta, black, cyan, and yellow are arranged in this order from the top. In other words, the ink storage chamber storing the ink of the deepest color (black) is arranged, with respect to the driving circuit and the heat transfer plate, at a position to which the heat generated by the driving circuit and the heat transfer plate is transferred to this ink storage chamber in an amount or extent smaller than to another ink storage chamber storing the ink of the lightest color (yellow). However, the present invention is not limited to such a construction or structure as described above. It is also allowable to arrange the ink storage chambers such that the remaining other colors other than the deepest color and the lightest color, in arbitrary order, provided that the light-color ink is stored in the ink storage chambers facing and disposed closest to the heat transfer plate 50 and that the deep-color ink with the high-visibility (black) is stored in the ink storage chamber at a position more apart or farther from the heat transfer plate 50 than the ink storage chamber storing the light color ink. For example, the magenta ink or the cyan ink may be arranged closest to the heat transfer plate 50, or in a case where light cyan and light magenta inks are included, these light-color inks may be disposed near the heat transfer plate 50. Further, it is desired that the nozzle rows, to which the deep-color ink with the high-visibility (black ink) is supplied, is one of the nozzle rows arranged outermostly in the recording head 30. It is desired that the nozzle row, to which the ink in the ink storage chamber closest to the heat transfer plate 50 is supplied, is arranged between the nozzle rows of inks having colors (for example, magenta and cyan) other than the color ink with the highest visibility. However, the nozzle row, to which the ink of the highest-visibility color is supplied, may be adjacent to another nozzle row to which the ink in the ink storage chamber closest to the heat transfer plate 50 is supplied. In other words, unless the nozzle row to which the ink in the ink storage chamber closest to the heat transfer plate 50 is supplied, is either one of the outermost rows, the remaining other nozzle rows may be disposed in any order.

Figure 12:
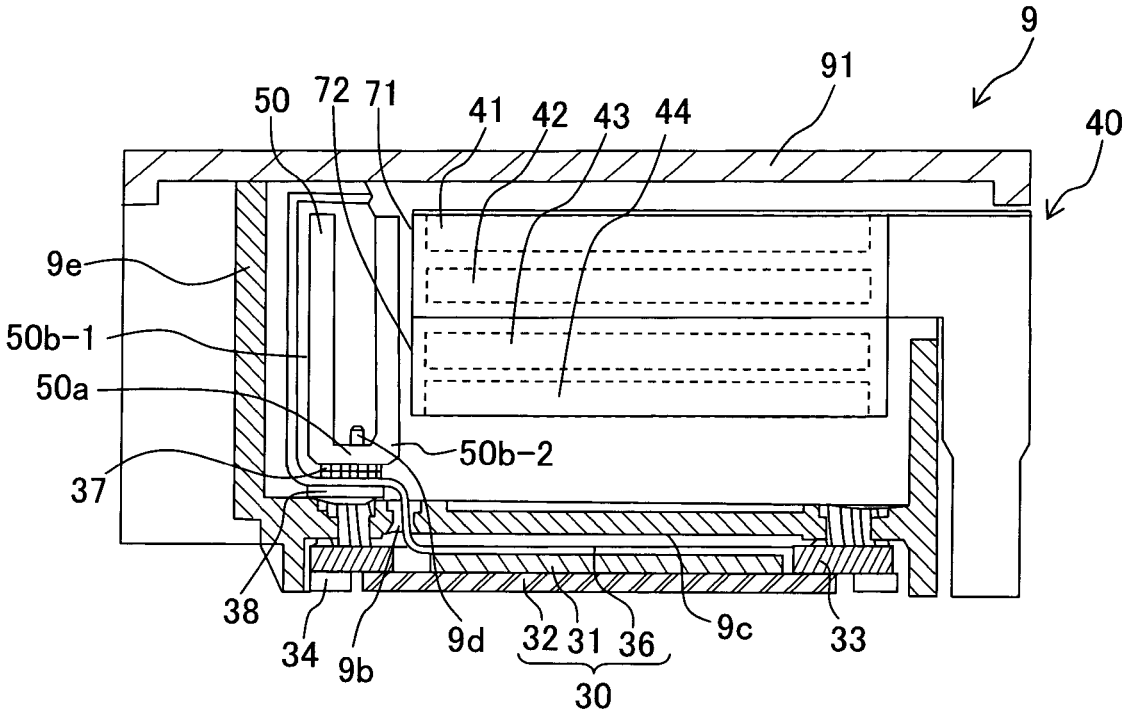
FIG. 12 is a sectional side view of a head holder 9 of another embodiment.

Next, a second embodiment will be explained by using FIG. 12 to FIGS. 14A, 14B. FIG. 12 is a sectional side view of a head holder 9 of the second embodiment. As in the first embodiment, on a lower side of the head holder 9, a recording head 30 in which a cavity unit 32 having a plurality of nozzles 35 for respective colors (respective color inks), a piezoelectric actuator 31, and a flexible wiring member 36 are stacked is held integrally with a reinforcing frame 33 and a rectangular shaped frame 34, and an ink tank 40 storing the color inks are accommodated in an upper portion of the head holder 9. The nozzles 35 are arranged substantially in the same manner as the arrangement of the nozzles shown in FIG. 4. In the case shown in FIG. 4, the nozzle rows are arranged in order of 35M, 35Y, 35C, 35B. On the other hand, in this case, a nozzle row for a magenta ink, a nozzle row for a cyan ink, a nozzle row for a yellow ink, and a nozzle row for a black ink are arranged in this order in a scanning direction of the recording head 30. In the cavity unit 32, common ink chambers 321M, 321Y, 321C and 321B arranged in parallel to one another are formed corresponding to the nozzle rows, respectively. The inks are supplied to these common ink chambers 321M, 321Y, 321C and 321B from ink inlet ports 320M, 320Y, 320C and 320B respectively, and a plurality of ink pressure chambers 322M, 322Y, 322C and 322B communicating with the common ink chambers 321M, 321Y, 321C and 321B, respectively, are also formed corresponding to the respective nozzles. The flexible wiring member 36 has one end connected to the piezoelectric actuator 31 and the other end inserted to a through hole 9*b* of a bottom wall 9*c* of the head holder 9 from under, and a driving circuit 37 mounted on the flexible wiring member 36 is in contact with a heat transfer plate 50 in a heat conductive manner. In the following explanation, the same members and components as those of the first embodiment will be assigned the same reference numerals and symbols.

As shown in FIG. 12, the ink tank 40, similarly to that in the first embodiment, includes an upper ink case 71 and a lower ink case 72 which are connected to each other in an up and down direction. As in the first embodiment, in the ink tank 40, an ink lead-in portion 40*e*, a damper portion 40*b*, and an ink lead-out portion 40*d*, though not shown in the drawings, are adjacently connected. In the damper portion 40*b*, a yellow ink storage chamber 41 (see FIG. 13A) and a magenta ink storage chamber 42 (see FIG. 13B) are formed in the upper ink case 71 to be adjacent in the up and down direction on an upper side and a lower side respectively, via a wall 71*c* partitioning the inside of the upper ink case 71 into upper and lower portions. A cyan ink storage chamber 43 (see FIG. 14A) and a black ink storage chamber 44 (see FIG. 14B) are formed to be adjacent in the lower ink case 72 in the up and down direction on an upper side and a lower side respectively, via a wall 72*c* partitioning the inside of the lower ink case 72 into upper and lower portions. In short, the ink tank 40 stores the yellow ink, the magenta ink, the cyan ink, and the black ink in this order from the top.

The ink lead-out portion 40*d* has ink lead-out channels 91Y, 91M, 91C, 91B in a number corresponding to that of the ink storage chambers 41 to 44, and these ink lead-out channels 91Y to 91B are arranged in order so as to correspond to the order in which the nozzle rows for the respective ink colors are arranged. The ink lead-out channels 91Y to 91B extend in the up and down direction along the upper and lower ink cases 71, 72, and have, on lower ends thereof, ink supply ports 39Y, 39M, 39C, 39B communicating with ink passage ports 33Y, 33M, 33C and 33B and ink inlet ports 320Y, 320M, 320C and 320B, respectively. The ink lead-out channels 91Y to 91B are formed for the ink colors, respectively, in such a manner that partition walls 40*g* divide insides of cylindrical walls 40*k*, 40*f* of the upper and lower ink cases 71, 72 and the cylindrical walls 40*k*, 40*f* and the partition walls 40*g* are joined together by ultrasonic welding, bonding, or the like.

The ink lead-in portion 40*e* includes an extension portion 40*a*, and on a lower surface of the extension portion 40*a*, formed are ink lead-in ports 22M, 22C, 22B, 22Y and ink lead-in channels 61M, 61C, 61B, 61Y through which the plural inks from ink cartridges for the respective colors are led into the ink tank 40.

Lower surfaces of the ink lead-in channels 61M to 61Y are formed in a groove shape and their openings are sealed with a film 85. The extension portion 40*a* is integrally connected to the wall 71*c*, and back ends of the ink lead-in channels 61M, 61C, 61B and 61Y are connected to ink lead-in channels 63M, 63C, 63B, 63Y, respectively, which are formed on upper and lower surfaces of the extension portion 40*a*, via ink lead-in holes 62M, 62C, 62B, 62Y penetrating through the extension portion 40*a* in the up and down direction.

As will be described later, the left-end ink lead-in channel 62Y and the right-end ink lead-in channel 62M are connected to the yellow ink storage chamber 41 and the magenta ink storage chamber 42, respectively, of the ink case 71; and the center ink lead-in channels 62C, 62B are connected to the cyan ink storage chamber 43 and the black ink storage chamber 44, respectively, of the ink case 72.

At positions, in opposing surfaces of the ink cases 71, 72, overlapping in a plan view with back ends of the center ink lead-in channels 63C, 63B, cylindrical walls 92*a*, 92*b* are formed, and upper ends of ink lead-in channels 64B, 64C penetrating through the cylindrical walls 92*a*, 92*b* are connected to the back ends of the ink lead-in channels 63B, 63C, respectively.

By joining the cylindrical walls 92*a*, 92*b* together by ultrasonic welding, bonding, or the like, the ink lead-in channels 63C, 63B of the upper ink case 71 are connected to the ink storage chambers 43, 44, respectively, of the lower ink case 72 via the ink lead-in channels 64C, 64B; and by joining the aforesaid cylindrical walls 40*k*, 40*f*, the upper and lower ink cases 71, 72 are mutually connected to be integrated together.

Construction of the Yellow Ink Storage Chamber 41

Figure 13A:
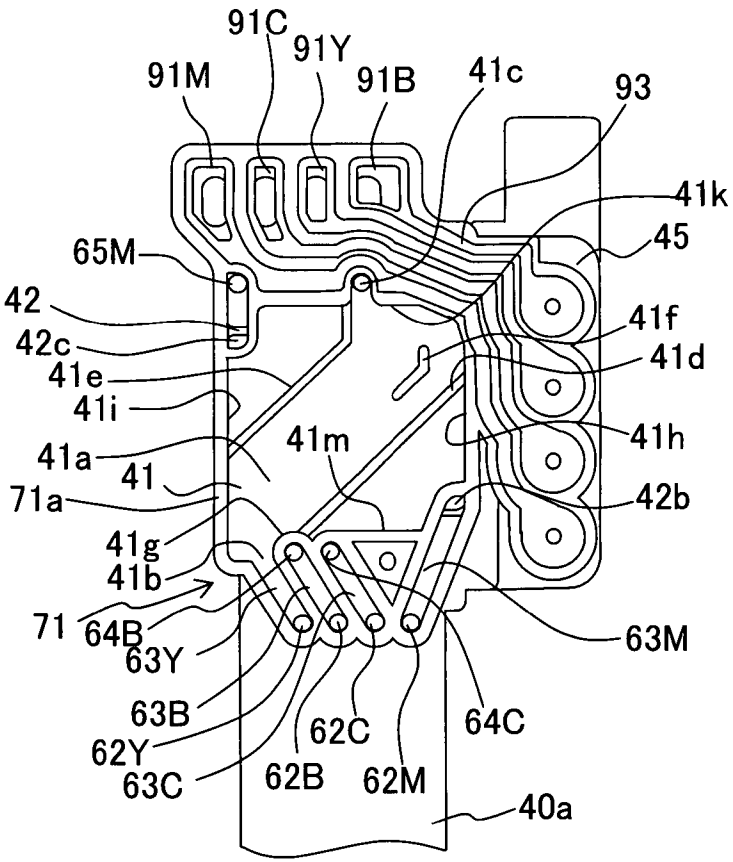
FIG. 13A is a plan view of an upper ink case 71 according to the another embodiment viewed from an upper side.

Next, the yellow ink storage chamber 41 will be explained with reference to FIGS. 13(A), 13(B). As shown in FIG. 13A, on an upper surface of the wall 71*c* of the ink case 71, the ink storage chamber 41 is formed, which has a substantially quadrangular horizontal cross section, of which upper surface is open in the same shape, and of which four peripheral sides are defined by walls 41*i*, 41*m*, 41*h* and 41*k*, substantially in the same manner as in the first embodiment. This storage chamber 41 is used as the yellow ink storage chamber. An entrance 41*b* of the yellow ink is disposed at the same position as that of the first embodiment, and an exit 41*c* of the yellow ink is formed in a back wall 41K at a position which is slightly rightward from the center in the left and right direction, and is deviated in the left direction to a small extent from a back right corner of the yellow ink storage chamber 41, and slightly projecting backward from the back wall 41*k*.

Figure 13B:
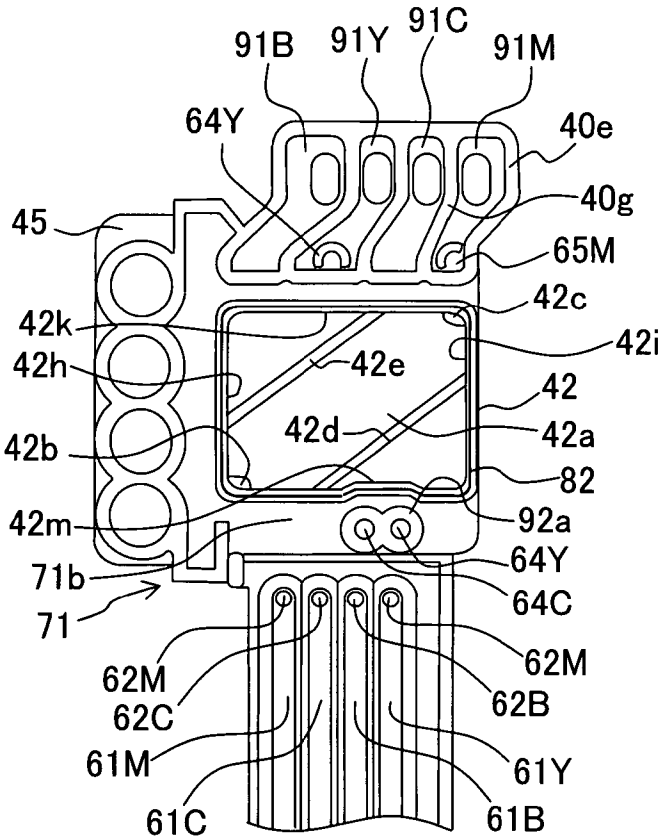
FIG. 13B is a plan view of the upper case 71 of the another embodiment viewed from a lower side.

The exit 41*c* of the yellow ink penetrates a bottom surface of the yellow ink storage chamber 41 to a lower surface 71*b* (FIG. 13B) of the ink case 71 to be connected to the ink lead-out channel 91Y (FIG. 13B). A guide wall 64 formed in the ink lead-out channel 91Y surrounds the periphery of a lower surface side of the ink exit 41*c* so as to guide the ink to a bottom of the ink lead-out channel 91Y. Note that, the ink lead-out channels 91M, 91C, 91Y and 91B extend forward so as to overlap with the yellow ink exit 41*c* and a black ink exit 44*c* are overlapped in the up and down direction between the yellow ink storage chamber 41 and the black ink storage chamber 44.

In each the yellow ink storage chamber 41, the ink lead-in channels 63Y, 63B, 63C and 63M, and the discharge channel 93, the opening thereof which is open upwardly is sealed with a flexible film 81 as in the first embodiment; and the yellow ink storage chamber 41, the ink lead-in channels 63Y, 63B, 63C and 63M, and the discharge channel 93 are demarcated or partitioned by joining the film 81 to the upper surface of the yellow ink storage chamber 41, the ink lead-in channels 63Y, 63B, 63C and 63M, and the discharge channel 93 by bonding, thermal welding, or the like. Ribs 41*d*, 41*e*, 41*f* are also provided in the same manner as in the first embodiment.

Construction of the Magenta Ink Storage Chamber 42

The magenta ink storage chamber 42 will be explained with reference to FIG. 13B. Since FIG. 13B shows the ink case 71 viewed from a lower side, the left direction of the drawing is "the right direction" and the right direction of the drawing is "the left direction".

As shown in FIG. 13B, the ink storage chamber 42 on a lower side of the upper ink case 71 has the same structure as that of the first embodiment. This storage chamber is used as the magenta ink storage chamber. On a lower surface of the wall 71*c* of the upper ink case 71, formed is the magenta ink storage chamber 42 which has a substantially quadrangular horizontal cross section, of which lower surface is open, and of which peripheral four sides are defined by walls 42*i*, 42*m*, 42*h* and 42*k*. The magenta ink storage chamber 42 is arranged adjacent to the yellow ink storage chamber 41 via the wall 71*c*.

A magenta ink entrance 42*b* and a magenta ink exit 42*c* of the magenta ink storage chamber 42 are formed at similar positions as those of the first embodiment, penetrating through the upper ink case 71. The magenta ink entrance 42*b* is connected to one end of the ink lead-in channel 63M (FIG. 13A). A connection lead-out channel 65M is formed outside the yellow ink storage chamber 41 on an upper surface of the upper ink case 71 at a position corresponding to the magenta ink exit 42*c*. One end of the connection lead-out channel 65M is connected to the magenta ink exit 42*c* penetrating through the ink case 71 and the other end thereof penetrates through the ink case 71 from the upper surface to the lower surface thereof to be connected to the magenta ink lead-out channel 91M.

The yellow ink storage chamber 41 and the magenta ink storage chamber 42 are arranged adjacent to each other via the wall 71*c* of the ink case 71, and the entrance 41*b* and exit 41*c* for the yellow ink and the entrance 42*b* and exit 42*c* for the magenta ink are set at positions different from each other along the wall 71*c*. An opening of the magenta ink storage chamber 42, which is open downwardly, is sealed with a flexible film 82. The film 82 is joined to sidewalls 42*h*, 42*k*, 42*i* and 42*m* of the ink storage chamber 42 by bonding, thermal welding, or the like, thereby demarcating or defining the ink storage chamber 42. Ribs 42*d*, 43*e* are also provided in a similar manner as in the first embodiment.

Construction of the Cyan Ink Storage Chamber 43

The cyan ink storage chamber 43 will be explained with reference to FIG. 14A and FIG. 14B. Since FIG. 14B shows the lower ink case 72 viewed from a lower side, the left direction of the drawing is "the right direction" and the right direction of the drawing is "the left direction".

Figure 14A:
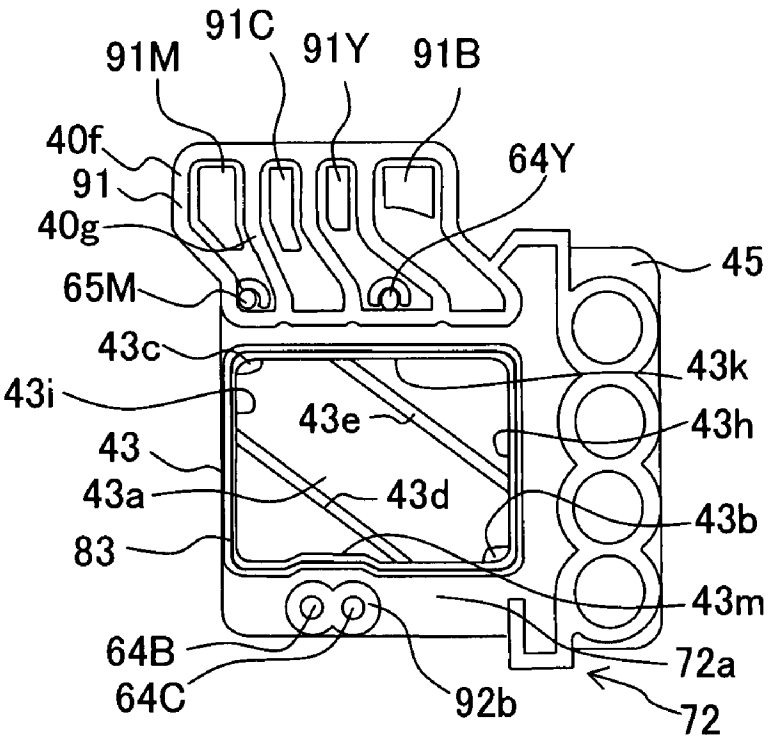
FIG. 14A is a plan view of a lower ink case 72 of the another embodiment viewed from an upper side.
Figure 14B:
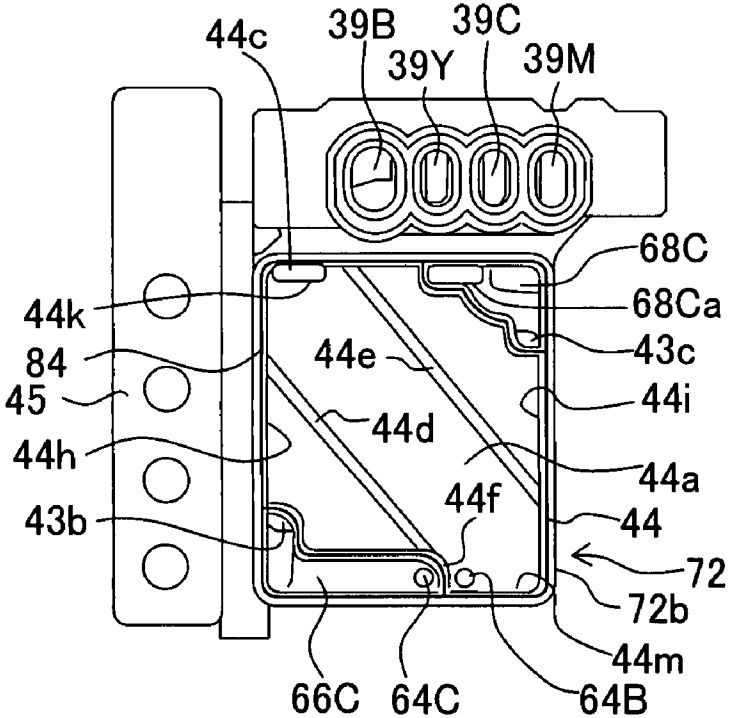
FIG. 14B is a plan view of the lower ink case 72 of the another embodiment viewed from a lower side.

As shown in FIG. 14A, on an upper surface 72*a* of the lower ink case 72, the ink storage chamber 43 having a similar structure as that of the first embodiment is formed, and this storage chamber is used as the cyan ink storage chamber. The cyan ink storage chamber 43, in the same shape as the shape of the magenta ink storage chamber 42, is formed at a position corresponding to the magenta ink storage chamber 42. An upper side of the cyan ink storage chamber 43 is open, and four sides thereof are defined by walls 43*i*, 43*m*, 43*h* and 43*k*. On a bottom 43*a* of the cyan ink storage chamber 43, ribs 43*d*, 43*e* in the same shape as the shape of the ribs 42*d*, 42*e* are provided.

Similarly to the surface, of the magenta ink storage chamber 42, having the opening formed therein, the opening of the cyan ink storage chamber 43 is sealed with a flexible film 83 having a substantially rectangular shape.

In short, the ink case 71 and the ink case 72 are mutually connected, with the film 82 of the magenta ink storage chamber 42 and the film 83 of the cyan ink storage chamber 43 facing each other in parallel and at a spacing distance.

A cyan ink entrance 43*b* and a cyan ink exit 43*c* of the cyan ink storage chamber 43 are formed at similar positions as those of the first embodiment, and both penetrating through the ink case 72 in a thickness direction, so that the cyan ink entrance 43*b* is connected to one end of an ink lead-in channel 66C formed on a lower surface of the ink case 72, and that the cyan ink exit 43*c* is connected to a connection lead-out channel 68C.

The ink lead-in channel 66C is formed outside the black ink storage chamber 44 and has an L-shape along a right front corner of the black ink storage chamber 44, and the other end of the ink lead-in channel 66C is connected to a lower end of the ink lead-in channel 64C.

In short, the ink lead-in channel 63C of the ink case 71 communicates with the cyan ink entrance 43*b* of the cyan ink storage chamber 43 via the ink lead-in channel 64C, which penetrates through the ink case 71 and the ink case 72 in the stacking direction, and via the ink lead-in channel 66C.

The connection lead-out channel 68C is formed outside the black ink storage chamber 44 and has an L-shape along a left back corner of the black ink storage chamber 44. This connection lead-out channel 68C and back portions of the black ink storage chamber 44 are positioned so as to overlap with the ink lead-out channels 91M to 91B in a plan view, and the other end 68Ca of the connection lead-out channel 68C penetrates through the ink case 72 from a lower side and an upper side thereof to be connected to the ink lead-out channel 91C.

Construction of the Black Ink Storage Chamber 44

The black ink storage chamber 44 will be explained with reference to FIG. 14B.

As shown in FIG. 14B, in a nearly similar manner as in the first embodiment, the ink storage chamber 44 which has a substantially quadrangular horizontal section and of which lower surface is open in the same shape is formed in a lower portion of the ink case 72. The ink storage chamber 44 is demarcated or defined by walls 44*i*, 44*m*, 44*h*, 44*k* corresponding to four sides thereof and is arranged adjacent to the cyan ink storage chamber 43 via the wall 72*c*. This ink storage chamber 43 is used as the black ink storage chamber. The cyan ink lead-in channel 66C and the cyan connection lead-out channel 68C are demarcated adjacent to the right front corner and the left back corner, respectively, of the black ink storage chamber 44.

A front portion of the black ink storage chamber 44 is positioned to overlap with the ink lead-in channel 64B in a plan view, and the ink lead-in channel 64B is formed at a similar position as that of the first embodiment and serves as an ink entrance 44*b* of the black ink storage chamber 44.

The black ink exit 44*c* is formed in the black ink storage chamber 44 at a position near to a right back corner of a bottom 44*a*, and penetrates through the ink case 72 in the up and down direction to communicate with the ink lead-out channel 91B.

The black ink storage chamber 44 and the cyan ink storage chamber 43 are arranged adjacent to each other via the wall 72*c* of the ink case 72, and the entrance 44*b* and the exit 44*c* of the black ink and the entrance 43*b* and the exit 43*c* of the cyan ink are arranged at positions different from each other, along the wall 72*c*.

In each of the black ink storage chamber 44, the ink lead-in channel 66C, and the connection lead-out channel 68C, the opening thereof which is open downwardly is sealed with a flexible film 84, and the film 84 is joined to the opening of each of the black ink storage chamber 44, the ink lead-in channel 66C, and the connection lead-out channel 68C, by bonding, thermal welding, or the like, thereby demarcating or partitioning the aforesaid black ink storage chamber 44, ink lead-in channel 66C, and connection lead-out channel 68C. Further, on the bottom 44*a* of the black ink storage chamber 44, ribs 44*d*, 44*e* are provided in an upright manner similar as in the first embodiment.

Next, the flow of the inks will be explained. With respect to the yellow ink, after flowing through the ink lead-in channels 61Y, 63Y, the yellow ink is led into the yellow ink storage chamber 41 from the yellow ink entrance 41*b* to flow toward the yellow ink exit 41*c*, and then flows through the ink lead-out channel 91Y, the ink supply port 39Y, and the ink passage port 33Y of the reinforcing frame 33 to be supplied, from the ink inlet port, to the nozzle row (not shown) which is disposed at a position close to the center, and which is different from the nozzle rows disposed outermostly in the recording head 30.

With respect to the magenta ink, after flowing through the ink lead-in channels 61M, 63M, the magenta ink is led into the magenta ink storage chamber 42 on the lower side of the ink case 71 from the magenta ink entrance 42*b* to flow toward the magenta ink exit 42*c*, and then flows through the ink lead-out channel 91M, the ink supply port 39M, and the ink passage port 33M to be supplied, from the ink inlet port, to one of the nozzle rows (not shown) disposed outermostly in the recording head 30.

With respect to the cyan ink, after led to the ink lead-in channels 61C, 63C, the cyan ink flows through the ink lead-in channel 64C, which penetrates through the ink cases 71, 72 in the stacking direction, to flow into the ink lead-in channel 66C on a lower side of the lower ink case 72, and thereafter the cyan ink is led, from the cyan ink entrance 43*b*, into the cyan ink storage chamber 43 on the upper side in the lower case 72. Then, the cyan ink flows toward the cyan ink exit 43*c* to flow through the ink lead-out channel 91C, the ink supply port 39C, and the ink passage port 33C to be supplied, from the ink inlet port, to the center nozzle row (not shown) of the recording head 30.

The black ink is led into the ink lead-in channels 61B, 63B (FIG. 5), and flows through the ink lead-in channel 64B, which penetrates through the ink cases 71, 72 in the stacking direction, to be led into the black ink storage chamber 44 on the lower side of the ink case 72. Then, the black ink flows from the black ink entrance 44*b* toward the black ink exit 44*c* to flow through the ink lead-out channel 91B, the ink supply port 39B, and the ink passage port 33B to be supplied, from the ink inlet port, to the other of the nozzle rows (not shown) disposed outermostly in the recording head 30.

Next, the heat transfer plate 50 will be explained.

As shown in FIG. 12, the heat transfer plate 50 includes a bottom surface portion 50*a* having a flat surface and two body portions 50*b*-1, 50*b*-2 which are bent in a substantially U-shape form in a side view to extend upward from both sides, respectively, of the bottom surface portion 50*a*. In the bottom surface portion 50*a* of the heat transfer plate 50, holes 50*d* are formed and the heat transfer plate 50 is fixed in such a manner that projections 9*d* provided on the bottom wall 9*c* of the head holder 9 are fitted to the holes 50*d* and the projections 9*d* are thermally deformed. The body portions 50*b* (50*b*-1, 50*b*-2) of the heat transfer plate 50 extend upward in parallel along a sidewall 9*e* of the head holder 9 and a side surface of the ink tank 40, and the body portions 50*b* are disposed apart from each other with a spacing distance. The flexible wiring member 36 inserted to and drawn out from the through hole 9*b* of the head holder 9 to pass along a lower surface of the bottom surface portion 50*a* of the heat transfer plate 50 and then passes between the body portion 50*b*-1 and the sidewall 9*e* of the head holder 9 to be led outside of the head holder 9. The driving circuit 37 on the flexible wiring member 36 is brought into contact with the bottom surface portion 50*a* of the heat transfer plate 50 in a heat conductive manner, by a rubber resilient member 38 sandwiched between the driving circuit 37 and the bottom wall 9*c*. Therefore, the heat transfer plate 50 is capable of releasing the heat transferred from the driving circuit 37 to a space in the head holder 9. An upper surface of the head holder 9 is covered with a cover member 91.

In the second embodiment, since the heat transfer plate 50 has a substantially U-shape form in a side view, the heat transfer plate 50 is small in size yet can release a large amount of heat. Furthermore, one of the body portions 50 (body portion 50*b*-2) of the heat transfer plate 50 extends along and contiguously to the ink storage chambers 41 to 44 arranged in the up and down direction, and the heat generated by the driving circuit 37 is transferred to the bottom surface portion 50*a*, which is a lower end of the heat transfer plate 50, to raise the temperature of the body portions 50*b* (body portion 50*b*-2). Thus, the heat can be transferred to the ink storage chambers 41 to 44. It is enough that the heat transfer plate 50 is disposed only along and apart from the side surface of the ink tank 40, and therefore the heat transfer plate 50 may have another shape, for example, a substantially reverse L-shape in a side view or an L-shape in a side view.

When the heat transfer plate 50 is arranged as in the second embodiment, since the heat from the driving circuit 37 is conducted in the heat transfer plate 50 more easily than air, the heat is conducted in the body portion 50*b*-2 to heat an upper space in the head holder 9. Further, the heat from the driving circuit 37 heats air in the head holder 9 to generate convection of the air, which in turn heats in particular the upper space in the head holder 9, thereby making the thermal influence to be greatest on the uppermost layer 41 of the ink storage chambers. That is, the position, to which the heat generated by the driving circuit and the heat transfer plate is transferred to the highest degree or extent, corresponds to the uppermost layer.

The ink storage chamber 41 greatly affected by the thermal influence is designated as the storage chamber of the yellow ink which is lowest-visibility color, and since the yellow, magenta, cyan, and black ink storage chambers are formed in this order from the top, the thermal influence from the driving circuit is largest on the low-visibility yellow ink and is relatively small on the highest-visibility black (deepest color) ink. In other words, the deepest color ink, namely, the black ink is arranged at a position to which the heat generated by the driving circuit and the heat transfer plate is transferred to the lowest degree or extent, and the lightest color ink, namely, the yellow ink is arranged at a position to which the heat generated by the driving circuit and the heat transfer plate is transferred to the highest degree or extent. Furthermore, since the heated yellow ink is supplied to the common ink chamber between the common ink chambers of the black ink and the cyan ink in the recording head 30, the black ink and the cyan ink in the common ink chambers, which are arranged on both sides, respectively, of the common ink chamber for the yellow ink, are also heated by the heat of the yellow ink, which consequently reduces temperature variation among the ink colors. Therefore, a printing error, if any, such as deviation from a landing position or variation in dot diameter of the light-color ink is less conspicuous owing to low visibility of the light-color ink in spite of a large thermal influence given to the light-color ink. Further, since the high-visibility black ink is less affected by the heat or affected by the heat to a smaller extent, it is possible to suppress the deterioration in printing quality, thereby realizing high-quality printing as a whole.

It should be noted that the arrangement of the ink storage chambers is not limited to the above-described structure. It is allowable that the inks of the colors other than the light-color ink and the deep-color ink are arranged in any order, provided that the light-color ink is stored in the ink storage chamber facing the upper end of the heat transfer plate 50 and the ink of the high-visibility deep color (black) is stored in the ink storage chamber other than the ink storage chamber facing the upper end of the heat transfer plate 50.

For example, the magenta ink or the cyan ink may be disposed closest to the upper end of the heat transfer plate 50, or in a case in which light cyan and light magenta are included, these light-color inks may be disposed near to the upper end of the heat transfer plate 50. Further, it is desired that the nozzle row, to which the ink of the high visibility deep color (black ink) is supplied, is disposed at one of the nozzle rows disposed outermostly in the recording head.

In the second embodiment, the nozzle row, to which the highest visibility ink is supplied, is adjacent to the nozzle row to which the ink in the ink storage chamber closest to the heat transfer plate 50 is supplied. However, the nozzle row, to which the ink in the ink storage chamber close to the upper end of the heat transfer plate 50 is supplied, may be disposed between the nozzle rows for the inks of the colors (for example, magenta and cyan) other than the highest-visibility ink color. That is, unless the outermost row is the nozzle row to which the ink in the ink storage chamber closest to the upper end of the heat transfer plate 50 is supplied, the other nozzle rows may be arranged in any order.

With the above-described construction, in the ink-jet recording apparatus jetting inks of the plural colors in the ink tank 40, a printing error, if any, such as deviation from a landing position and/or variation in dot diameter of the light-color ink is less conspicuous owing to the low visibility of the light color in spite of a large thermal influence given to the light-color ink. Further, since the high-visibility black ink is affected by thermal influence to a smaller extent, deterioration in printing quality can be reduced, thereby realizing high-quality printing as a whole. Furthermore, since the heat transfer plate 50 is formed in the U-shape and extends in the up and down direction in parallel to the ink tank 40, a heat release effect is high and the whole head holder can be compact, thereby providing a compact ink-jet recording apparatus.

What is claimed is:

1. An ink-jet recording apparatus which performs recording by jetting a plurality of color inks including a deep-color ink and a light-color ink, the apparatus comprising:

a recording head which has a plurality of nozzle rows arranged in a predetermined arrangement direction corresponding to the color inks, respectively, each of the nozzle arrays having a plurality of nozzles, and which applies pressures to the color inks to jet the inks from the nozzles;

a plurality of ink storage chambers storing the color inks respectively;

a plurality of ink supply ports through which the inks are supplied from the ink storage chambers to the nozzle rows, respectively;

a driving circuit which drives the recording head; and a heat transfer plate which is in contact with the driving circuit in a heat-conductive manner and which is disposed adjacent to the ink storage chambers; wherein:

an ink storage chamber, among the ink storage chambers, which stores the deep-color ink is disposed at a position, with respect to the driving circuit and the heat transfer plate, at which heat generated by the driving circuit and the heat transfer plate is transferred to the ink storage chamber to an extent smaller than to another ink storage chamber which stores the light-color ink; and a color ink, among the color inks, which is stored in an ink storage chamber among the ink storage chambers and heated most by the heat, is supplied to a nozzle row which is different from nozzle rows disposed outermostly in the nozzle rows.

2. The ink-jet recording apparatus according to claim 1, wherein:

the ink storage chambers are arranged in a predetermined direction;

the heat transfer plate is disposed to face an ink storage chamber, among the ink storage chambers, which is disposed at one end in the predetermined direction;

the ink storage chamber storing the deep-color ink is disposed at a position farther from the heat transfer plate than the ink storage chamber storing the light-color ink; and a color ink among the color inks and supplied from an ink storage chamber, among the ink storage chambers, which faces the heat transfer plate and which is disposed most closely to the heat transfer plate, is supplied to the nozzle row which is different from the nozzle rows disposed outermostly.

3. The ink-jet recording apparatus according to claim 2, wherein the ink storage chamber, which faces the heat transfer plate and which is disposed most closely to the heat transfer plate, stores a color ink, among the color inks, which has a lightest color.

4. The ink-jet recording apparatus according to claim 1, wherein the ink storage chambers function as damper chambers which absorb a pressure change in the color inks to be supplied to the recording head.

5. The ink-jet recording apparatus according to claim 4, wherein one wall surface of each of the ink storage chambers is formed of a flexible film.

6. The ink-jet recording apparatus according to claim 2, wherein:

a color ink, among the color inks, stored in an ink storage chamber, among the ink storage chambers, facing the heat transfer plate and disposed farthest from the heat transfer plate, is supplied to one of the nozzle rows disposed outermostly in the nozzle rows; and another color ink, among the color inks, supplied from an ink storage chamber, among the ink storage chambers, facing the heat transfer plate and disposed most closely to the heat transfer plate, is supplied to the nozzle row which is different from the nozzle rows disposed outermostly.

7. The ink-jet recording apparatus according to claim 1, wherein:

the ink storage chambers are stacked in an up and down direction;

a lower end of the heat transfer plate is in contact with the driving circuit in the heat conductive manner, and the heat transfer plate extends upward in parallel to a direction, in which the ink storage chambers are arranged, with a spacing distance from the ink storage chambers;

the ink storage chamber storing the deep-color ink is disposed at a position farther from an upper end of the heat transfer plate than the ink storage chamber storing the light-color ink; and an ink, in an ink storage chamber among the ink storage chambers and facing the upper end of the heat transfer plate, is supplied to the nozzle row which is different from the nozzle rows disposed outermostly.

8. The ink-jet recording apparatus according to claim 7, wherein the ink storage chamber on an uppermost layer of the stacked ink storage chambers stores a color ink, among the color inks, which has a lightest color.

9. The ink-jet recording apparatus according to claim 1, wherein the deep-color ink is a black ink.

10. The ink-jet recording apparatus according to claim 1, wherein the driving circuit is positioned on one side of the ink storage chambers, is in contact with the heat transfer plate in the heat conductive manner, and is arranged in parallel to the nozzle rows.

11. The ink-jet recording apparatus according to claim 1, wherein the heat transfer plate is formed of aluminum.

12. The ink-jet recording apparatus according to claim 11, wherein the heat transfer plate has a sidewall and a horizontal wall, and has a substantially L-shape form.

13. The ink-jet recording apparatus according to claim 11, wherein the heat transfer plate has a bottom surface and two body portions which project in a direction from both sides, respectively, of the bottom surface, and the heat transfer plate has a substantially U-shape form.

14. The ink-jet recording apparatus according to claim 1, further comprising an ink tank having an upper ink case and a lower ink case, wherein the ink storage chambers are formed in the upper ink case and the lower ink case respectively.

15. The ink-jet recording apparatus according to claim 14, wherein:

each of the upper ink case and the lower ink case has a wall partitioning an inside thereof into two layers; and each of the ink storage chambers are formed in one of the layers, respectively.

16. The ink-jet recording apparatus according to claim 14, wherein the ink tank further includes a discharge unit which discharges air separated from the inks.

* * * * *